US009977378B2

(12) United States Patent
Kuwana et al.

(10) Patent No.: US 9,977,378 B2
(45) Date of Patent: May 22, 2018

(54) HEATING DEVICE, DRYING DEVICE, FIXING DEVICE, IMAGE FORMING APPARATUS, AND IMAGE FORMING SYSTEM

(71) Applicants: Kohji Kuwana, Kanagawa (JP); Takahiro Inoue, Kanagawa (JP)

(72) Inventors: Kohji Kuwana, Kanagawa (JP); Takahiro Inoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/258,615

(22) Filed: Sep. 7, 2016

(65) Prior Publication Data

US 2017/0090361 A1 Mar. 30, 2017

(30) Foreign Application Priority Data

Sep. 30, 2015 (JP) ..... 2015-194308

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
None
See application file for complete search history.

(56) References Cited

U.S. PATENT DOCUMENTS

2011/0076069 A1 3/2011 Yagawara et al.
2011/0176851 A1 7/2011 Kuwana et al.
2012/0020689 A1 1/2012 Inoue et al.

FOREIGN PATENT DOCUMENTS

JP 2002023550 A * 1/2002
JP 2008-102413 5/2008

OTHER PUBLICATIONS

JP 2002023550 English machine translation, Takeshita et al., Jan. 2002.*
JP 2008102413 English machine translation, Kawasaki et al., May 2008.*

* cited by examiner

*Primary Examiner* — Thomas Giampaolo, II
(74) *Attorney, Agent, or Firm* — Harness, Dickey & Pierce, P.L.C.

(57) ABSTRACT

A heating device including a heating member, a heat source, multiple non-contact temperature detectors, a contact temperature detector, a heat source drive controller, and a temperature detection abnormality detector is provided. The heating member contacts a heating target being conveyed. The heat source supplies heat to the heating member. Each of the non-contact temperature detectors detects a first temperature of the heating member without contacting the heating member. The contact temperature detector detects a second temperature of the heating member by contact with the heating member. The heat source drive controller controls drive of the heat source based on the first temperatures. The temperature detection abnormality detector performs a determination on whether each one of the non-contact temperature detectors has an abnormality or not while the heating target is not conveyed, by comparing the first temperature and the second temperature.

18 Claims, 14 Drawing Sheets

HEATING DEVICE, DRYING DEVICE, FIXING DEVICE, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application No. 2015-194308, filed on Sep. 30, 2015, in the Japan Patent Office, the entire disclosure of which is hereby incorporated by reference herein.

BACKGROUND

Technical Field

The present disclosure relates to a heating device, a drying device, a fixing device, an image forming apparatus, and an image forming system.

Description of the Related Art

A conventional heating device for heating a heating target (e.g., recording medium) being conveyed is known, which includes a heat roll and a heater. The heat roll is a cylindrical heating member containing the heater inside. The heater supplies heat to the heat roll. The heat roll is brought into contact with the heating target when heating the heating target.

SUMMARY

In accordance with some embodiments of the present invention, a heating device is provided. The heating device includes a heating member, a heat source, a plurality of non-contact temperature detectors, a contact temperature detector, a heat source drive controller, and a temperature detection abnormality detector. The heating member contacts a heating target being conveyed. The heat source supplies heat to the heating member. Each of the plurality of non-contact temperature detectors detects a first temperature of the heating member without contacting the heating member. The contact temperature detector detects a second temperature of the heating member by contact with the heating member. The heat source drive controller controls drive of the heat source based on the first temperatures detected by the non-contact temperature detectors. The temperature detection abnormality detector performs a determination on whether each one of the non-contact temperature detectors has an abnormality or not while the heating target is not conveyed, by comparing the first temperature detected by the one of the non-contact temperature detectors and the second temperature detected by the contact temperature detector.

In accordance with some embodiments of the present invention, a drying device is provided. The drying device includes the above heating device to heat a drying target.

In accordance with some embodiments of the present invention, an image forming system is provided. The image forming system includes an image forming device and the above drying device. The image forming device applies an ink on a recording medium to form an image. The drying device is disposed downstream from the image forming device relative to a conveyance direction of the recording medium, to heat and dry the recording medium having the image thereon.

In accordance with some embodiments of the present invention, an image forming apparatus is provided. The image forming apparatus includes an image forming unit and a drying unit. The image forming unit applies an ink on a recording medium to form an image. The drying unit includes the above heating device, to heat and dry the recording medium having the image thereon.

In accordance with some embodiments of the present invention, a fixing device is provided. The fixing device includes the above heating device to soften or melt a toner on a recording medium by heat.

In accordance with some embodiments of the present invention, an image forming apparatus is provided. The image forming apparatus includes a toner image forming device and the above fixing device. The toner image forming device forms a toner image on a surface of a recording medium with a toner. The fixing device heats the surface of the recording medium having the toner image thereon to fix the toner image on the recording medium.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
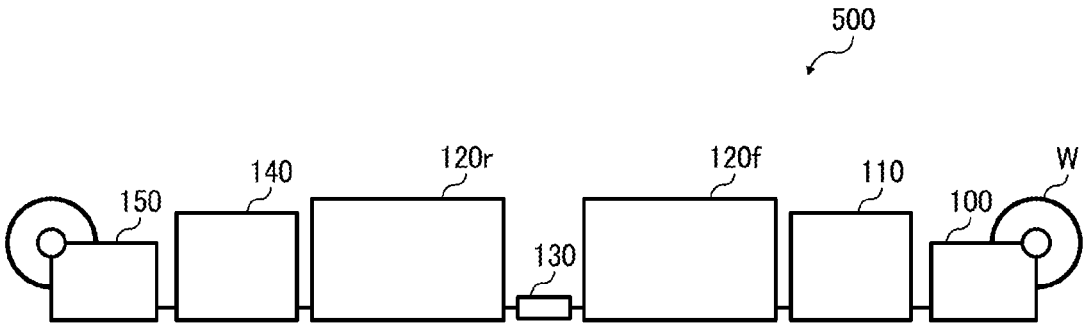
FIG. 1 is a schematic view of an image forming system according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In accordance with some embodiments of the present invention, a heating device is provided which includes a plurality of non-contact temperature detectors for detecting temperature of a heating member and one contact temperature detector for determining whether or not the non-contact temperature detectors have an abnormality, composed of a reduced number of assemblies.

Embodiment 1

Embodiment 1 of the present invention relates to a heating device included in an image forming system, specifically, an inkjet printing system.

FIG. 1 is a schematic view of an image forming system 500 according to an embodiment of the present invention (hereinafter "Embodiment 1").

The image forming system 500 forms images on a recording medium W, such as long continuous paper.

As illustrated in FIG. 1, the image forming system 500 includes, from an upstream side of the conveyance direction of the recording medium W, a sheet feeder 100, a treatment liquid applicator 110, a first printer 120*f*, a reverser 130, a second printer 120*r*, a drying device 140, and a post-processor 150.

In the image forming system 500 illustrated in FIG. 1, the recording medium W is fed from the sheet feeder 100 to the treatment liquid applicator 110. The treatment liquid applicator 110 applies a treatment liquid to both sides of the recording medium W. The recording medium W coated with the treatment liquid is then fed to the first printer 120*f* that is an inkjet printer. The first printer 120*f* discharges ink droplets to the front side of the recording medium W to form an image. The recording medium W is then reversed upside down by the reverser 130 and is fed to the second printer 120*r* that is an inkjet printer. The second printer 120*r* discharges ink droplets to the back side of the recording medium W to form an image. The recording medium W is then fed to the drying device 140. The drying device 140 dries both sides of the recording medium W by heat. The dried recording medium W is wound by the post-processor 150.

Figure 2:
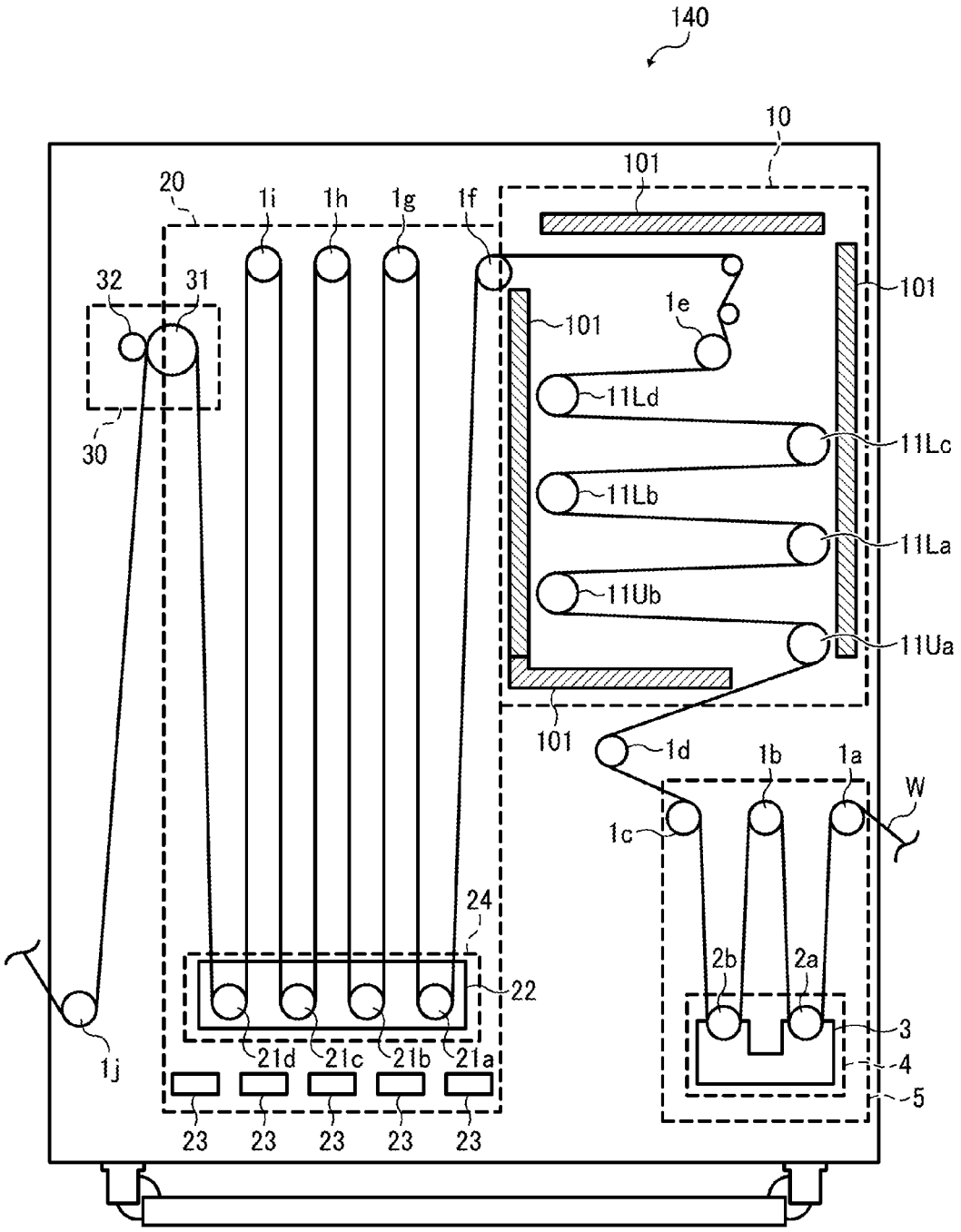
FIG. 2 is a schematic view of a drying device included in the image forming system illustrated in FIG. 1.

FIG. 2 is a schematic view of the drying device 140 included in the image forming system 500. The recording medium W is conveyable within the drying device 140.

As illustrated in FIG. 2, the drying device 140 includes, from an upper side of the conveyance direction of the recording medium W, a dancer mechanism 5, a drying mechanism 10, a cooling mechanism 20, and a conveyance mechanism 30. The drying device 140 further includes multiple rotatable guide rollers 1*a*, 1*b*, 1*c*, 1*d*, 1*e*, 1*f*, 1*g*, 1*h*, 1*i*, and 1*j* (hereinafter collectively "guide rollers 1") each having bearings on both ends. The guide rollers 1 securely provide a conveyance path for the recording medium W.

As the recording medium W reaches the drying device 140, the recording medium W is fed to the dancer mechanism 5 that absorbs a defection of the recording medium W. In the dancer mechanism 5, the recording medium W is wound around multiple rotatable dancer rollers 2*a* and 2*b* (hereinafter collectively "dancer rollers 2") and the guide rollers 1*a*, 1*b*, and 1*c*, disposed in between the dancer rollers 2, forming the shape of "W".

The dancer mechanism 5 includes a dancer movable frame 3 vertically movable relative to a casing of the drying device 140. The multiple dancer rollers 2 each have bearings on both ends, and are rotatably mounted to the dancer movable frame 3 via the bearings, forming a dancer unit 4. Thus, the dancer unit 4 is suspended by the recording medium W.

The dancer unit 4 is movable by the dancer movable frame 3 along the direction of gravity. The dancer mechanism 5 includes a dancer unit position detector to detect the position of the dancer unit 4. The position of the dancer unit 4 can be adjusted by controlling a drive source for a conveyance roller 31 included in the conveyance mechanism 30 in accordance with an output from the dancer unit position detector.

In a case in which the recording medium W is to be fed to the drying device 140 with no recording medium existing in the drying device 140, the dancer unit 4 is set to the upper limit of the movable range thereof in the vertical direction, so that the dancer rollers 2*a* and 2*b* and the guide rollers 1*a*, 1*b*, and 1*c*, around each of which the recording medium W is wound forming the shape of "W", come close to each other. This configuration makes an operator feed sheets more easily.

After passing though the dancer mechanism 5, the recording medium W reaches the drying mechanism 10.

The drying mechanism 10 includes multiple heat rolls 11Ua, 11Ub, 11La, 11Lb, 11Lc, and 11Ld (hereinafter collectively "heat rolls 11") each including no drive source. The multiple heat rolls 11 are arranged in a zigzag manner along the conveyance direction of the recording medium W, from a lower side to an upper side, within the drying mechanism 10. The multiple heat rolls 11 are rotatably supported. As the conveyance roller 31 is rotary-driven with the recording medium W wound around the multiple heat rolls 11, the recording medium W is conveyed and the heat rolls 11 are driven to rotate.

The heat rolls 11 are cylindrical members formed of a high-thermal-conductivity material, such as iron and aluminum. Each of the heat rolls 11 contains a heat source inside. The heat source is driven in accordance with a detection result from a temperature detector, such that the surface temperature of the heat roll 11 is properly controlled and the recording medium W in contact with the heat roll 11 is dried by heat.

The drying mechanism 10 is surrounded by thermal insulation walls 101 that suppress heat transmission to the outside of the drying mechanism 10.

After passing through the drying mechanism 10, the recording medium W is fed to the cooling mechanism 20. The cooling mechanism 20 includes multiple cooling rollers 21*a*, 21*b*, 21*c*, and 21*d* (hereinafter collectively "cooling rollers 21"). In the cooling mechanism 20, the recording medium W is wound around the multiple rotatable cooling rollers 21 and the guide rollers 1*f*, 1*g*, 1*h*, and 1*i*, disposed in between the cooling rollers 21, forming the shape of "W".

The cooling mechanism 20 includes a cooling movable frame 22 vertically movable relative to the casing of the drying device 140. The multiple cooling rollers 21 each have bearings on both ends, and are rotatably mounted to the cooling movable frame 22 via the bearings, forming a cooling unit 24. Thus, the cooling unit 24 is suspended by the recording medium W.

The cooling unit 24 is movable by the cooling movable frame 22 along the direction of gravity. The cooling mechanism 20 includes a cooling unit position detector to detect the position of the cooling unit 24.

When cooling the recording medium W being conveyed, the cooling unit 24 is driven to move downward and fixed at a fixed position, so that cooling fans 23 can wind a wide area of the recording medium W as much as possible. The cooling unit 24 is fixed at the fixed position to be unmovable by a lock mechanism.

In a case in which the recording medium W is to be fed to the drying device 140 with no recording medium existing in the drying device 140, the cooling unit 24 is set to the upper limit of the movable range thereof in the vertical direction, so that the cooling rollers 21*a*, 21*b*, 21*c*, and 21*d* and the guide rollers 1*f*, 1*g*, 1*h*, and 1*i*, around each of which the recording medium W is wound forming the shape of "W", come close to each other. This configuration makes an operator feed sheets more easily.

After passing through the cooling mechanism 20, the recording medium W is fed to the conveyance mechanism 30 that includes the conveyance roller 31.

In the conveyance mechanism 30, the recording medium W is allowed to pass through between the conveyance roller 31, which is rotary-driven by a drive source (e.g., motor), and multiple conveyance nip rollers 32. The multiple conveyance nip rollers 32 are disposed along the axial direction of the conveyance roller 31 and pressed against the conveyance roller 31 with biasing members (e.g., springs).

Figure 3A:
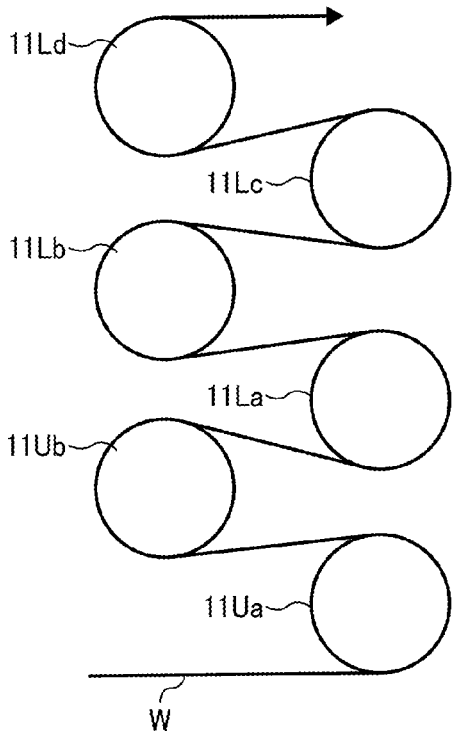
FIG. 3A is an arrangement chart of upper heat rolls and lower heat rolls included in the drying device illustrated in FIG. 2.
Figure 3B:
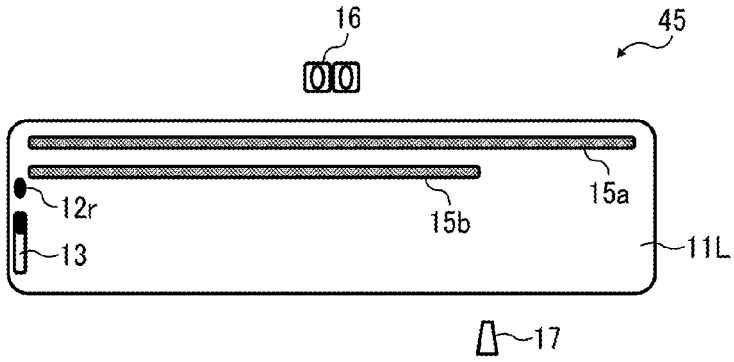
FIG. 3B is a schematic view of a lower heating mechanism including one of the lower heat rolls.
Figure 3C:
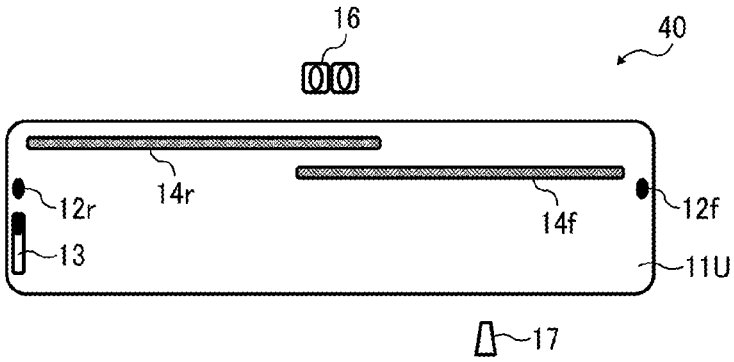
FIG. 3C is a schematic view of an upper heating mechanism including one of the upper heat rolls.

FIG. 3A is an arrangement chart of the upper heat rolls 11Ua and 11Ub (each of them may be hereinafter referred to as "upper heat roll 11U") and the lower heat rolls 11La, 11Lb, 11Lc, and 11Ld (each of them may be hereinafter referred to as "lower heat roll 11L"). FIG. 3B is a schematic view of a lower heating mechanism 45 including one of the lower heat rolls 11L. FIG. 3C is a schematic view of an upper heating mechanism 40 including one of the upper heat rolls 11U.

Figure 4:
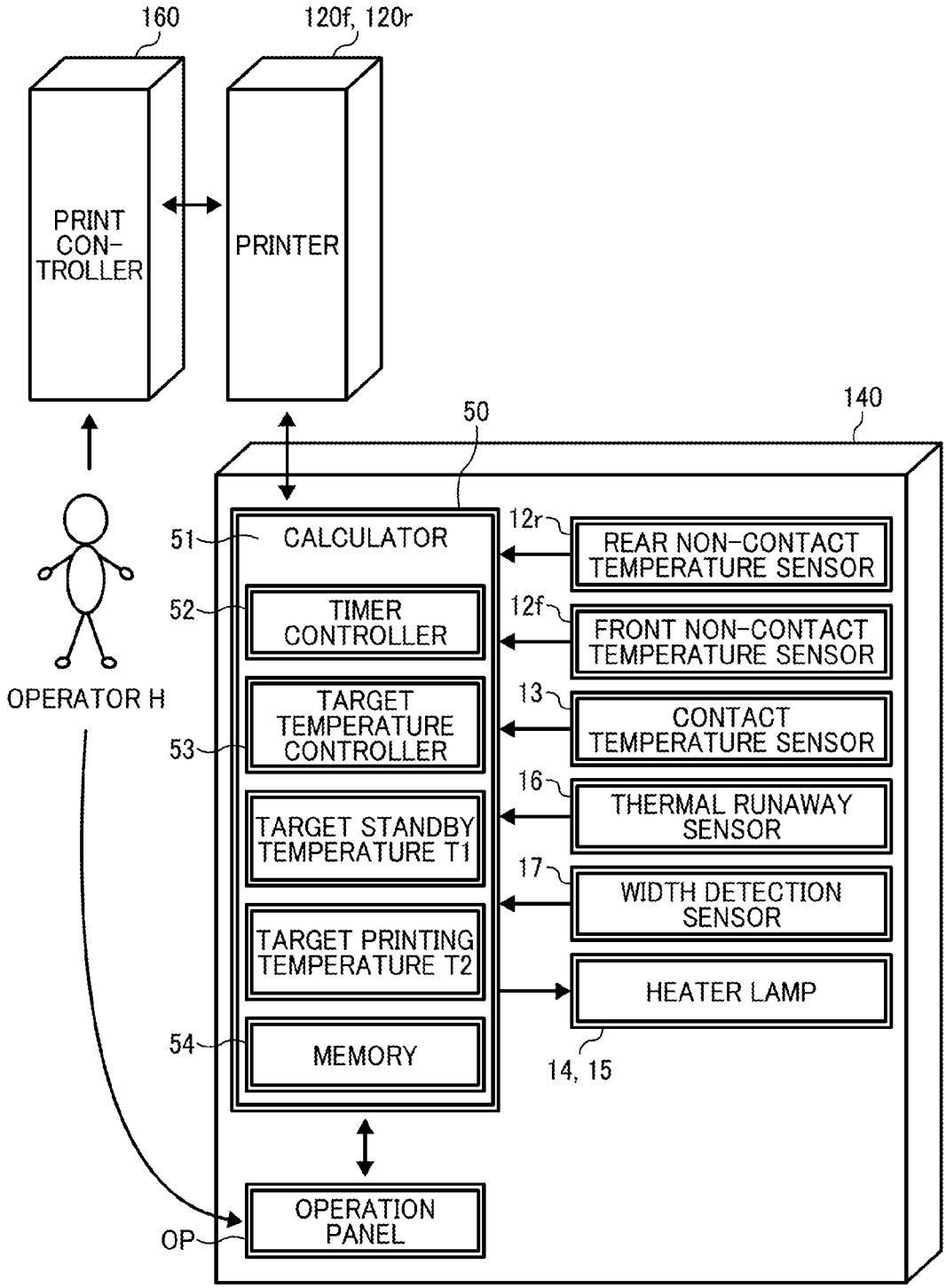
FIG. 4 is a block diagram of a control system of the drying device illustrated in FIG. 2.

FIG. 4 is a block diagram of a control system of the drying device 140 in the image forming system 500.

Figure 5:
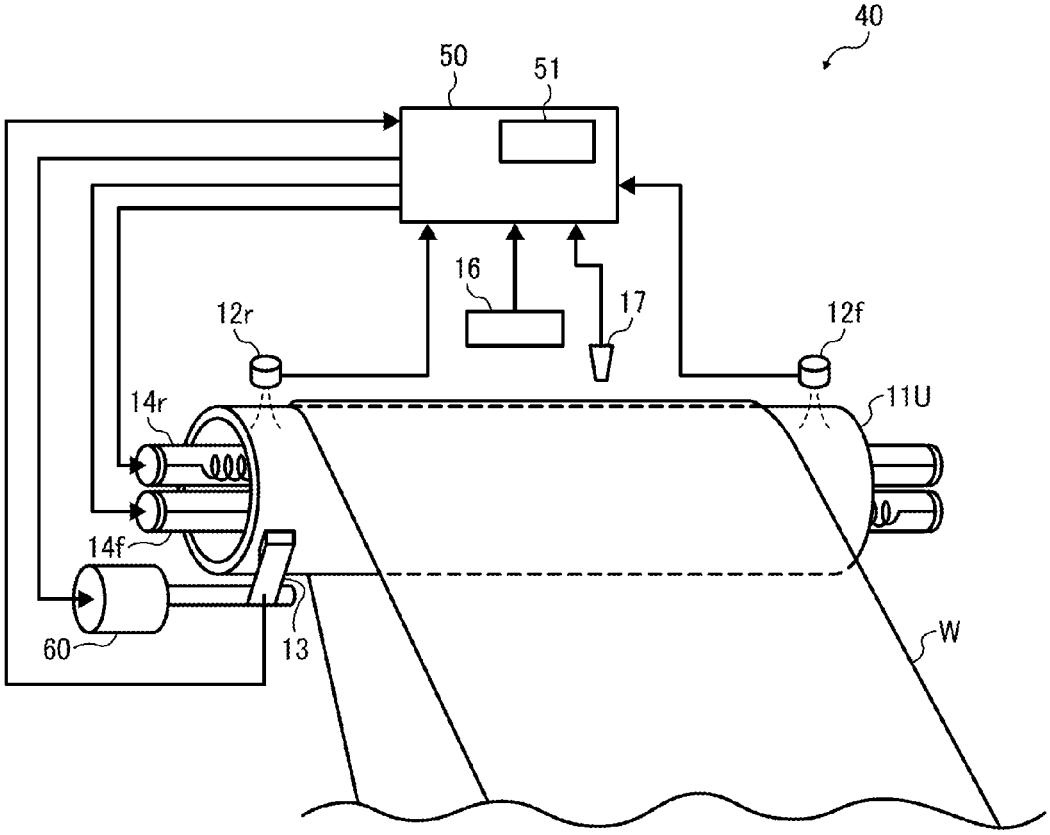
FIG. 5 is another schematic view of the upper heating mechanism illustrated in FIG. 3C.

FIG. 5 is a schematic view of the upper heating mechanism 40 in which the upper heat roll 11U heats the recording medium W.

The right sides in FIGS. 3B, 3C, and 5 correspond to the front side of the paper plane on which FIG. 2 is drawn, i.e., the front side of the drying device 140. The left sides in FIGS. 3B, 3C, and 5 correspond to the back side of the paper plane on which FIG. 2 is drawn, i.e., the rear side of the drying device 140.

As illustrated in FIG. 3A, the drying device 140 includes six heat rolls 11. Two of them are upper heat rolls 11U in each of which, as illustrated in FIG. 3C, a front heater lamp 14*f* and a rear heater lamp 14*r* are symmetrically arranged with respect to the center of the upper heat roll 11U in the axial direction. Four of them are lower heat rolls 11L in each of which, as illustrated in FIG. 3B, a long heater lamp 15*a* and a short heater lamp 15*b* are aligned at one side (i.e., the rear side) of the lower heat roll 11L in the axial direction.

As illustrated in FIGS. 3C and 5, the upper heat roll 11U includes the front heater lamp 14*f* and the rear heater lamp 14*r* serving as heat sources. A front non-contact temperature sensor 12*f* and a rear non-contact temperature sensor 12*r* are disposed facing the surface of the upper heat roll 11U at front and rear end parts of the upper heat roll 11U in the axial direction, respectively, for detecting the surface temperature of the upper heat roll 11U. Further, a contact temperature sensor 13 is disposed facing the surface of the upper heat roll 11U for detecting the surface temperature of the upper heat roll 11U by contact with a rear end part of the surface of the upper heat roll 11U in the axial direction.

Referring to FIG. 4, a heater controller 50 includes a calculator 51. The calculator 51 includes a timer controller 52, a target temperature controller 53, and a memory 54.

The heater controller 50 controls drive of the front heater lamp 14*f* and the rear heater lamp 14*r* based on detection results from the front non-contact temperature sensor 12*f* and the rear non-contact temperature sensor 12*r* disposed facing the surface of the upper heat roll 11U, to control the temperature of the upper heat roll 11U.

The contact temperature sensor 13 is brought into direct contact with the upper heat roll 11U. If the contact temperature sensor 13 is brought into contact with the upper heat roll 11U while the upper heat roll 11U is rotating, the contact temperature sensor 13 will be broken by friction and/or the surface of the upper heat roll 11U will be damaged. To avoid this problem, as illustrated in FIG. 5, a contact/separation motor 60 is provided. The contact/separation motor 60 is configured to bring the contact temperature sensor 13 into contact with the upper heat roll 11U while the upper heat roll 11U is not rotating.

As illustrated in FIG. 3B, the lower heat roll 11L includes the long heater lamp 15*a* and the short heater lamp 15*b* serving as heat sources. A rear non-contact temperature sensor 12*r* is disposed facing the surface of the lower heat roll 11L at a rear end part of the lower heat roll 11L in the axial direction, for detecting the surface temperature of the upper heat roll 11U. Further, a contact temperature sensor 13 is disposed facing the surface of the lower heat roll 11L for detecting the surface temperature of the lower heat roll 11L by contact with a rear end part of the surface of the lower heat roll 11L in the axial direction.

The contact temperature sensor 13 facing the lower heat roll 11L can be brought into contact with or separated from the lower heat roll 11L by a mechanism similar to the contact/separation motor 60 for the contact temperature sensor 13 facing the upper heat roll 11U.

The heater controller 50 controls drive of the long heater lamp 15*a* and the short heater lamp 15*b* based on detection results from the rear non-contact temperature sensor 12*r* disposed facing the surface of the lower heat roll 11L, to control the temperature of the lower heat roll 11L.

In case the non-contact temperature sensors 12*f* and 12*r* are got contaminated, an error may be caused in temperature detection. In case of breakdown of the non-contact temperature sensors 12*f* and 12*r*, thermal runaway may occur. To avoid such a temperature detection error and a damage caused by thermal runaway, the heater controller 50 executes a verify check which determines whether the temperatures detected by each of the non-contact temperature sensors 12 is correct or not, by comparing the temperatures detected by the non-contact temperature sensor 12 and the contact temperature sensor 13.

As illustrated in FIGS. 3B, 3C, and 5, the heating mechanisms 40 and 45 each include a thermal runaway sensor 16. The thermal runaway sensor 16 detects the heat roll 11U or 11L exceed the upper limit temperature, which may be caused by a breakdown of the non-contact temperature sensors 12*f* and/or 12*r*. Further, the heating mechanisms 40 and 45 each include a width detection sensor 17 that detects the width of the recording medium W.

The recording medium W enters the drying mechanism 10 from a lower part thereof. The recording medium W is discharged from an upper part thereof. Since the upper heat rolls 11U are disposed close to the entrance for the recording medium W, the amount of heat which is drawn by the recording medium W from the upper heat rolls 11U is greater than that drawn from the lower heat rolls 11L, at the time when conveyance of the recording medium W is started. Therefore, the heater lamps 14*f* and 14*r* contained in the upper heat rolls 11U have higher power than the heater lamps 15*a* and 15*b* contained in the lower heat rolls 11L.

In each of the upper heat rolls 11U, the heater lamps 14*f* and 14*r* are symmetrically arranged in the axial direction so that the temperature distribution within the upper heat roll 11U becomes uniform in the axial direction.

The front and rear sides of the upper heat roll 11U in the axial direction are heated by the front heater lamp 14*f* and the rear heater lamp 14*r*, respectively. To independently control the temperatures of the front and rear sides of the upper heat roll 11U, the front non-contact temperature sensor 12*f* and the rear non-contact temperature sensor 12*r* are respectively provided at the front and rear sides of the upper heat roll 11U.

Since the amount of heat which is drawn by the recording medium W from the lower heat rolls 11L is smaller than that from the upper heat rolls 11U, the lower heat rolls 11L are capable of effectively giving necessary heat to the recording medium W. In each of the lower heat rolls 11L, the rear ends of the long heater lamp 15*a* and the short heater lamp 15*b* are aligned, thus becoming capable of heating the recording medium W with various widths.

Since the rear end sides of the long heater lamp 15*a* and the short heater lamp 15*b* are disposed at the rear side of the lower heat roll 11L in the axial direction, just one rear non-contact temperature sensor 12*r* is disposed facing the rear side of the lower heat roll 11L.

In the drying mechanism 10 according to Embodiment 1, two non-contact temperature sensors 12*f* and 12*r* are installed at two respective positions, i.e., the front end side and the rear end side of each upper heat roll 11U. However, the number of non-contact temperature sensors 12 is not limited to two, so long as the number thereof is two or greater. The install positions of the non-contact temperature sensors 12 are not limited, either.

Figure 6:
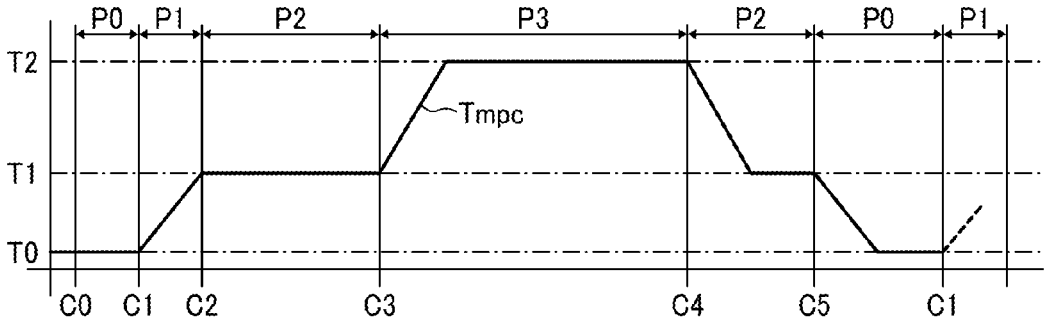
FIG. 6 is a graph showing a temporal change of the temperature detected by a non-contact temperature sensor.

FIG. 6 is a graph showing a temporal change of the temperature detected by the non-contact temperature sensor 12 (hereinafter "heater control temperature Tmpc") when the non-contact temperature sensor 12 for the heat roll 11 in the drying mechanism 10 has no abnormality.

The horizontal axis indicates a time elapsed from a time C0 when the drying device 140 is powered on, and the vertical axis indicates a temperature change.

At the time C0 when the drying device 140 is powered on, the heater lamps in the heating mechanisms 40 and 45 have not yet been energized, i.e., the drying device 140 is in a not-ready state P0, and the heater control temperature Tmpc is detected to be around normal temperature T0.

At a time C1 when an operator H presses a start/stop switch on an operation panel OP of the drying device 140, or a start-up command is input from a print controller 160, the drying device 140 transits from the not-ready state P0 to a temperature raising state P1. At the time C1, startup of the heater lamps is also started so that the heater control temperature Tmpc is increased from the normal temperature T0 to a target standby temperature T1. At a time C2 when the heater control temperature Tmpc reaches the target standby temperature T1, the drying device 140 transits to a ready state P2.

The verify check is executed at the times C1 and C2.

At the time C1, the heater control temperature Tmpc is around normal temperature T0 and the heater lamps 14 and 15 have not yet been driven. Thus, the surface temperature of the heat roll 11 is substantially uniform, which is suitable for comparing the temperatures detected by the non-contact temperature sensor 12 and the contact temperature sensor 13.

There is a possibility that the temperature detected by the non-contact temperature sensor 12 remains fixed to normal temperature T0 due to the occurrence of breakdown or contamination. There is another possibility that a detected temperature change is smaller than an actual temperature change. In view of these possibilities, the verify check is executed at the time C2 to confirm whether or not the temperature detected by the non-contact temperature sensor 12 has properly followed a surface temperature change of the heat roll 11.

The time C2 is detected as the temperature detected by the non-contact temperature sensor 12 reaches the target standby temperature T1. However, if the non-contact temperature sensor 12 has an abnormality, the time C2 will not be detected even when the surface temperature of the heat roll 11 actually reaches the target standby temperature T1, allowing further heating of the heat roll 11. To avoid this undesirable situation, in a case in which the detected temperature never reaches the target standby temperature T1 within a preset time period after the time C1, the heating mechanisms are suspected to have an abnormality, and drive of the heating mechanisms are suspended while displaying an error on the operation panel OP. In a case in which the temperature rise is too rapid, as the thermal runaway sensor 16 detects the temperature reach a preset temperature, the heating mechanisms are suspected to have an abnormality, and drive of the heating mechanisms are suspended while displaying an error on the operation panel OP.

At the time C2, there is a possibility that an uneven temperature distribution is caused on the surface of the heat roll 11 to some extent. However, since the heat roll 11 is having the target standby temperature T1 that is sufficiently smaller than a target printing temperature T2, the temperature difference between the recording medium W and the heat roll 11 is small. Therefore, heat is more likely to transmit throughout the heat roll 11 having a high thermal conductivity than to transfer from the heat roll 11 to the recording medium W having a low thermal conductivity.

The uneven temperature distribution caused at this time has no influence on execution of the verify check.

The drying device 140 transits from the ready state P2 to a running state P3 at a time C3 when receiving a conveyance start signal from the printer 120*f* or 120*r* (hereinafter "printer 120"). At the time C3, startup of the heater lamps is also started so that the heater control temperature Tmpc is increased from the target standby temperature T1 to the target printing temperature T2. The heater lamps are controlled such that the heater control temperature Tmpc is remained at the target printing temperature T2.

The drying device 140 transits from the running state P3 to the ready state P2 again at a time C4 when receiving a conveyance stop signal from the printer 120. At the time C4, shutdown of the heater lamps is also started so that the heater control temperature Tmpc is decreased from the target printing temperature T2 to the target standby temperature T1. The heater lamps are controlled such that the heater control temperature Tmpc is remained at the target standby temperature T1.

At a time C5 when the start/stop switch is pressed or a shut-down command is input from the print controller 160, the heater lamps are powered off and the drying device 140 transits from the ready state P2 to the not-ready state P0. The heater control temperature Tmpc is decreased to around the normal temperature T0.

In a case in which the heater lamps are powered off as a failure has occurred in the drying device 140, or another case in which the drying device 140 is switched to a mode (e.g., energy-saving mode) which powers off the heater lamps during the ready state P2, the heating mechanisms transit to the not-ready state P0.

As described above, the verify check for the non-contact temperature sensors 12*f* and 12*r* is executed at the times C1 and C2.

At the time C1, the contact/separation motor 60 is driven so that the contact temperature sensor 13 is brought into contact with the heat roll 11. After a lapse of a certain time period (i.e., the time constant of the sensor), outputs from the contact temperature sensor 13 and the non-contact temperature sensor 12 are obtained.

Similarly, at the time C2, outputs from the contact temperature sensor 13 and the non-contact temperature sensor 12 are obtained.

In the verify check, whether or not the difference between the temperatures detected by the non-contact temperature sensor 12 and the contact temperature sensor 13 is within a specified temperature range is checked.

In a case in which the recording medium W is wide, temperature control is performed in the following manner.

Figure 7:
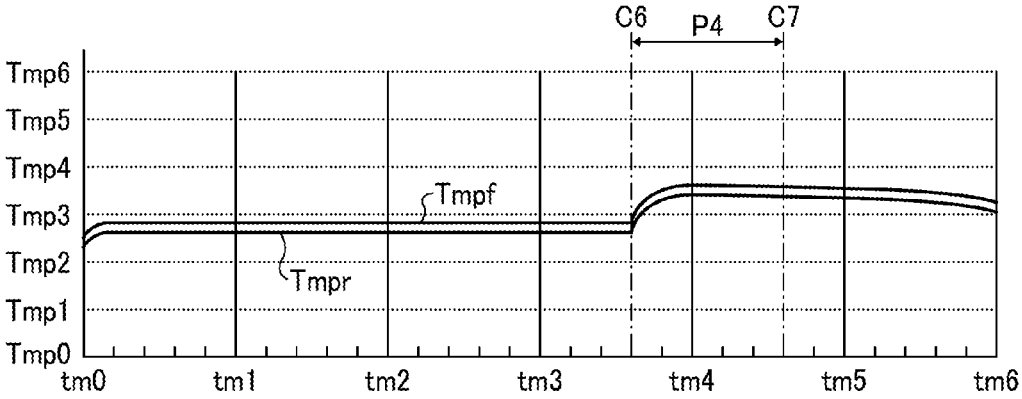
FIG. 7 is a graph showing temporal changes of the temperatures detected by two non-contact temperature sensors for the upper heat roll, when a recording medium in use is wide.

FIG. 7 is a graph showing temporal changes of the temperatures detected by the two non-contact temperature sensors 12 for the upper heat roll 11U, when the recording medium W in use is wide.

The vertical axis indicates target temperatures Tmp0 to Tmp6. Upper sides of the vertical axis indicate higher temperatures, i.e., Tmp0<Tmp6.

The horizontal axis indicates elapsed times tm0 to tm6. Right sides of the horizontal axis indicate longer elapsed times, i.e., tm0<tm6.

In FIG. 7, Tmpf indicates the temperature detected by the front non-contact temperature sensor 12*f* disposed at the front end side of the drying device 140 (i.e., the front side of the paper plane on which FIG. 2 is drawn). Tmpr indicates the temperature detected by the rear non-contact temperature sensor 12*r* disposed at the rear end side of the drying device 140 (i.e., the back side of the paper plane on which FIG. 2 is drawn).

At a time C6 in FIG. 7, conveyance of the recording medium W is stopped. A time C7 comes after a lapse of a certain time period from the time C6. This time period is a temperature evening period P4 needed for evening out the temperature distribution unevenness occurred in the upper heat roll 11U.

When the recording medium W is wide, during a printing period, there is no difference between Tmpf detected by the front non-contact temperature sensor 12*f* and Tmpr detected by the rear non-contact temperature sensor 12*r*. It is to be noted that, in FIG. 7, Tmpf and Tmpr are drawn with an appropriate shift in the vertical direction for descriptive purposes.

Because the wide recording medium W contacts the upper heat roll 11U covering the entire area of the upper heat roll 11U in the width direction, heat is uniformly transmitted from the upper heat roll 11U to the entire area of the recording medium W in the width direction. Therefore, in the upper heat roll 11U, a large temperature difference does not generate between the rear end side, at which one side edge of the recording medium W is aligned, and the front end side, at which the moving position of the other side edge of the recording medium W is varied, either during the printing period or after the time C6 when the printing is stopped.

Figure 8:
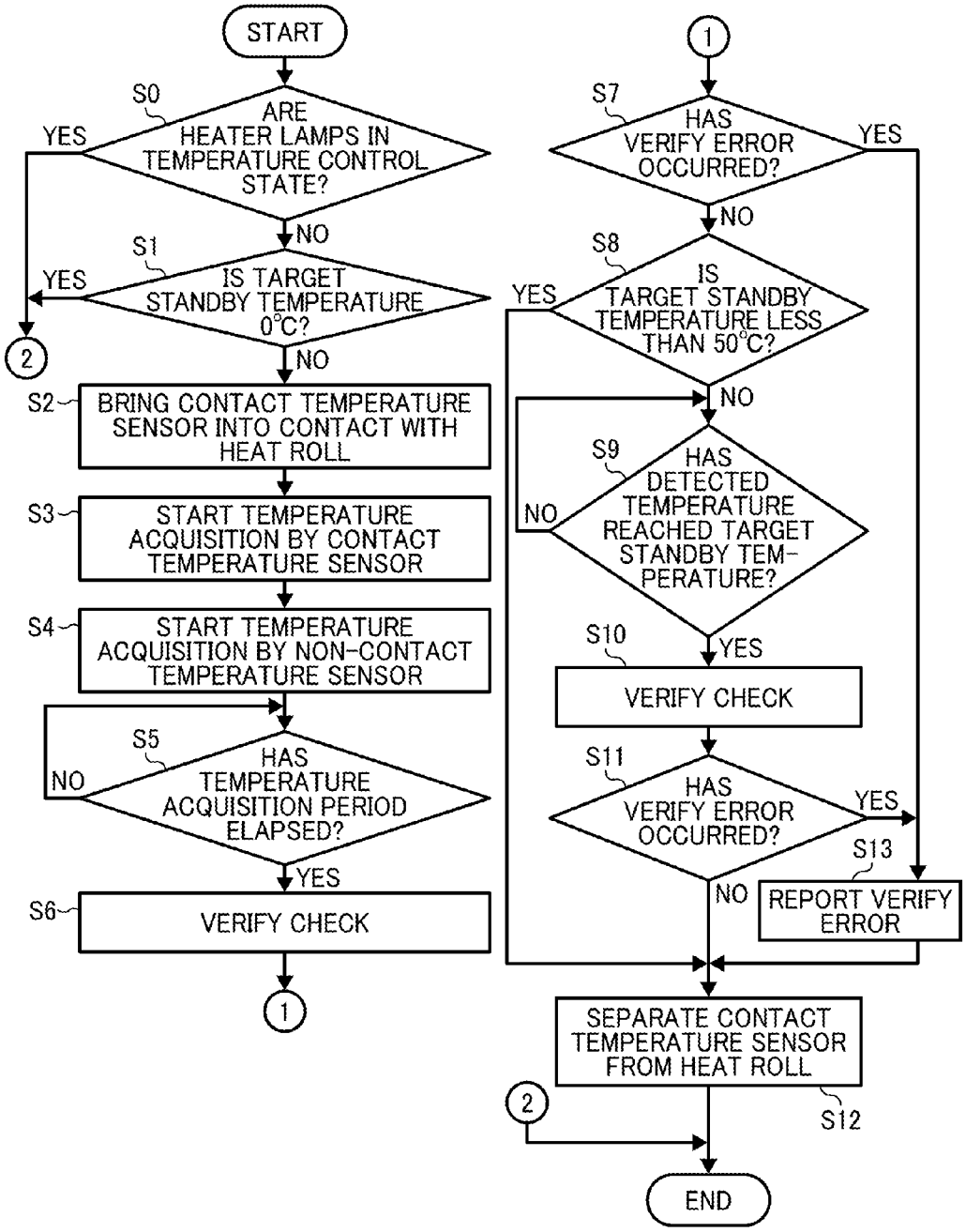
FIG. 8 is a flowchart illustrating a control of a verify check processing for non-contact temperature sensors, when a recording medium in use is wide.

FIG. 8 is a flowchart illustrating a control of a verify check processing for the non-contact temperature sensors 12 for the upper heat roll 11U and the lower heat roll 11L, when the recording medium W in use is wide.

As the verify check processing is started, the conditions of the heater lamps 14 or 15 are checked to determine whether to execute the verify check or not (S0). Referring to step S0 in FIG. 8, "temperature control state" refers to a state in which outputs of the heater lamps are under control based on the temperatures detected by the non-contact temperature sensors 12, which corresponds to the time period between C2 and C5 in FIG. 6. When the heater lamps are in the temperature control state (Yes in S0), it means that the verify check has been already executed or now being executed. Thus, the verify check processing is terminated without executing the verify check.

When the heater lamps are not in the temperature control state (No in S0), the target standby temperature T1 is checked to determine whether to execute the verify check or not (S1). The drying device 140 is capable of drying the recording medium W either by heating the heat rolls 11 or only by conveying the recording medium W without heating the heat rolls 11. In the latter case, the target standby temperature T1 is set to 0° C. through an input device (e.g., the operation panel OP).

Therefore, in a case in which the target standby temperature T1 is set to 0° C. (Yes in S1), the heater lamps are not subject to temperature control, and the verify check processing is terminated.

In a case in which the target standby temperature T1 is not 0° C. (No in S1), the contact/separation motor 60 is driven to bring the contact temperature sensor 13 into contact with the heat roll 11 (S2), to execute the verify check of the non-contact temperature sensors 12.

The contact temperature sensor 13 then starts temperature acquisition (S3), and the non-contact temperature sensors 12 start temperature acquisition (S4). Next, whether a temperature acquisition period has been elapsed or not is checked (S5). When the temperature acquisition period has been elapsed (Yes in S5), temperature data detected by the contact temperature sensor 13 and the non-contact temperature sensors 12 (hereinafter "temperature detection data") is confirmed. When the temperature acquisition period has not been elapsed and any of the sensors are still detecting temperature (No in S5), the processing awaits until the temperature acquisition period has elapsed.

Since the contact temperature sensor 13 has a property of incapable of correctly detecting the temperature of a measurement target immediately after contacting the measurement target, the temperature acquisition period is set in accordance with the time constant of the sensor.

At the time when the temperature acquisition period is elapsed, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U. With respect to the lower heat roll 11L, the contact temperature sensor 13 and the rear non-contact temperature sensor 12*r*, both disposed at the rear side of the lower heat roll 11L in the axial direction, execute detection of the temperature of the rear-side surface of the lower heat roll 11L in the axial direction.

Next, the first verify check is executed at the time C1 (S6). In the first verify check, the temperatures detected by the contact temperature sensor 13 and the rear non-contact temperature sensor 12*r*, both disposed at the rear side of the upper heat roll 11U in the axial direction, are compared with reference to the temperature detection data obtained in S5. Specifically, it is determined whether the difference between the temperatures detected by the contact temperature sensor 13 and the rear non-contact temperature sensor 12*r* is within the range of from −20° C. to +20° C. This determination is performed for both the upper heat roll 11U and the lower heat roll 11L.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

In Embodiment 1, in the verify check, it is confirmed that the non-contact temperature sensors 12*f* and 12*r* have detected correct temperatures when the difference between the temperatures detected by the non-contact temperature sensors 12*f* or 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

Next, whether a verify error has occurred or not is checked (S7). When an abnormality is detected in the comparison result made in the verify check of S6 (Yes in S7), a verify error is reported (S13).

When no abnormality is detected in the comparison result made in the verify check of S6 (No in S7), the target standby temperature T1 is checked (S8). In a case in which the target standby temperature T1 is less than 50° C. (Yes in S8), the second verify check is not executed at the time C2 when the temperature reaches the target standby temperature T1. In this case, the contact temperature sensor 13 is separated from the heat roll 11 (S12).

In the above case in which the target standby temperature T1 is less than 50° C., the detected temperature will not be different from normal temperature, since the difference between the temperatures detected by the contact temperature sensor 13 and the non-contact temperature sensors 12 is specified to be within a range of from −20° C. to +20° C. In this case, the second verify check is not executed since it will not be different from the first verify check executed in C6.

In Embodiment 1, whether to execute the verify check when the temperature has reached the target standby temperature T1 is determined based on the criteria that whether the target standby temperature T1 is less than 50° C. (T1<50° C.) or not. This criterion varies depending on the configuration of the drying mechanism 10, environmental temperature, etc., and is not limited thereto.

In a case in which the target standby temperature T1 is 50° C. or greater (No in S8), the second verify check is executed at the time C2 when the temperature reaches the target standby temperature T1. To execute the second verify check, whether or not the temperature detected by the rear non-contact temperature sensor 12*r* or the front non-contact temperature sensor 12*f* has reached the target standby temperature T1 is checked (S9). In a case in which neither of the temperatures detected by the rear non-contact temperature sensor 12*r* nor the front non-contact temperature sensor 12*f* has reached the target standby temperature T1 (No in S9), execution of the verify check is suspended until the detected temperature reaches the target standby temperature T1.

At the time C2 when the detected temperature reaches the target standby temperature T1, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U. With respect to the lower heat roll 11L, the contact temperature sensor 13 and the rear non-contact temperature sensor 12*r*, both disposed at the rear side of the lower heat roll 11L in the axial direction, execute detection of the temperature of the rear-side surface of the lower heat roll 11L in the axial direction.

Since the contact temperature sensor 13 has a property of incapable of correctly detecting the temperature of a measurement target immediately after contacting the measurement target, a temperature acquisition period is generally needed in accordance with the time constant of the sensor. However, since the contact temperature sensor 13 is in contact with the heat roll 11 during the temperature raising state P1, there is no need to wait until the time period corresponding to the time constant of the sensor has elapsed.

In a case in which any of the rear non-contact temperature sensor 12*r* and the front non-contact temperature sensor 12*f* has reached the target standby temperature T1 (Yes in S9), the second verify check is executed (S10). In the second verify check, the temperatures detected by the contact temperature sensor 13 and the rear non-contact temperature sensor 12*r* are compared with reference to the temperature detection data obtained at the time C2. Specifically, it is determined whether the difference between the temperatures detected by the contact temperature sensor 13 and the rear non-contact temperature sensor 12*r* is within the range of from −20° C. to +20° C. This determination is performed for both the upper heat roll 11U and the lower heat roll 11L.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

Next, whether a verify error has occurred or not is checked (S11). When an abnormality is detected in the comparison result made in the second verify check of S10 (Yes in S11), a verify error is reported (S13).

When no abnormality is detected in the comparison result made in the second verify check of S10 (No in S11), the contact temperature sensor 13 is separated from the heat roll 11 (S12) to terminate the verify check. Thus, the verify check processing is terminated.

In the verify error reporting processing (S13), a verify error is reported to upper modules, such as the print controller 160 and the printer 120.

A verify error is detected in S7 or S11 when the difference between the temperatures detected by the front non-contact temperature sensor 12*f* or the rear non-contact temperature sensor 12*r* and the contact temperature sensor 13 is out of the specified range. In this case, it is recognized that the front non-contact temperature sensor 12*f* or the rear non-contact temperature sensor 12*r* has an abnormality. The verify error is reported to upper modules and all the heater lamps 14 and 15 are powered off. In addition, the contact/separation motor 60 is driven to separate the contact temperature sensor 13 from the heat roll 11 (S12).

In a case in which the recording medium W is narrow, temperature control is performed in the following manner.

Figure 9:
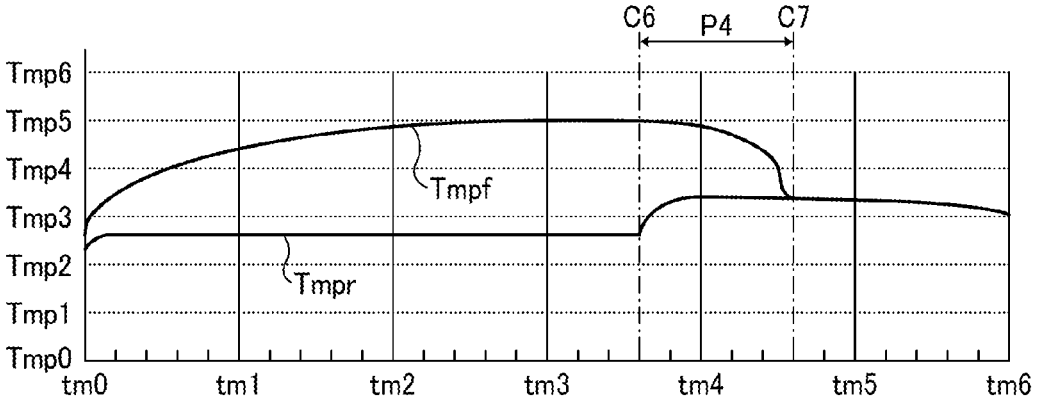
FIG. 9 is a graph showing temporal changes of the temperatures detected by two non-contact temperature sensors for the upper heat roll, when a recording medium in use is narrow.

FIG. 9 is a graph showing temporal changes of the temperatures detected by the two non-contact temperature sensors 12 for the upper heat roll 11U, when the recording medium W in use is narrow.

The vertical axis indicates target temperatures Tmp0 to Tmp6. Upper sides of the vertical axis indicate higher temperatures, i.e., Tmp0<Tmp6.

The horizontal axis indicates elapsed times tm0 to tm6. Right sides of the horizontal axis indicate longer elapsed times, i.e., tm0<tm6.

In FIG. 9, Tmpf indicates the temperature detected by the front non-contact temperature sensor 12*f* disposed at the front end side of the drying device 140 (i.e., the front side of the paper plane on which FIG. 2 is drawn). Tmpr indicates the temperature detected by the rear non-contact temperature sensor 12*r* disposed at the rear end side of the drying device 140 (i.e., the back side of the paper plane on which FIG. 2 is drawn).

At a time C6 in FIG. 9, conveyance of the recording medium W is stopped. A time C7 comes after a lapse of a certain time period from the time C6. This time period is a temperature evening period P4 needed for evening out the temperature distribution unevenness occurred in the upper heat roll 11U.

As illustrated in FIG. 9, when the recording medium W is narrow, during a printing period (before the time C6), Tmpf detected by the front non-contact temperature sensor 12*f* is higher than Tmpr detected by the rear non-contact temperature sensor 12*r*. The reason for this phenomenon is considered as follows.

During conveyance of the recording medium W, the rear edge of the recording medium W in the width direction is aligned to a reference position that is set on the rear side of the heat roll 11. Therefore, the position of the front edge of the recording medium W in the width direction varies depending on the width of the recording medium W. Thus, when the recording medium W is narrow, the front-side surface of the upper heat roll 11U in the axial direction is not covered with the recording medium W. In this case, the front heater lamp 14*f* for heating the front-side surface of the upper heat roll 11U in the axial direction, which is not covered with the recording medium W, is powered off. The upper heat roll 11U is temperature-controlled only by the rear heater lamp 14*r*.

The rear-side surface of the upper heat roll 11U remains at around a target temperature because the output of the rear heater lamp 14*r* is controlled based on the temperature detected by the rear non-contact temperature sensor 12*r*, as indicated by the curve Tmpr in FIG. 9. On the other hand, the front-side surface of the upper heat roll 11U becomes higher because heat transferred from the rear-side surface is continuously released from the front-side surface, as indicated by the curve Tmpf in FIG. 9.

When the printing operation is stopped, the target surface temperature of the upper heat roll 11U is set to the target standby temperature T1 that is sufficiently lower than the target printing temperature T2, and a temperature change will occur in the following manner.

Namely, the temperature of the front-side surface of the upper heat roll 11U rapidly decreases, because heat is easily released from the front-side surface owing to the absence of the recording medium W. Thus, after a lapse of the temperature evening period P4, during which the temperatures of the rear and front sides of the upper heat roll 11U become equal, from the time C6 when the printing is stopped, the surface temperature of the upper heat roll 11U becomes substantially uniform.

There may be a case in which the rear heater lamp 14*r* is powered off due to the occurrence of a failure before a lapse of the temperature evening period P4 after the time C6 when the printing operation is stopped, or another case in which the drying device 140 is switched to another mode (e.g., energy-saving mode) which powers off the rear heater lamp 14*r* during the temperature evening period P4. In these cases, the upper heating mechanism 40 transits to the not-ready state P0. There may be a case in which the rear heater lamp 14*r* is restarted up immediately after the upper heating mechanism 40 has transited to the not-ready state P0 as the start/stop switch is pressed. In this case, the verify check for the front non-contact temperature sensor 12*f* is executed with the front-side surface temperature of the upper heat roll 11U being higher than the rear-side surface temperature of the upper heat roll 11U.

If the verify check is executed with the front-side surface temperature being higher than the rear-side surface temperature, even when the front non-contact temperature sensor 12*f* has correctly detected temperature, the difference between the temperatures detected by the front non-contact temperature sensor 12*f* and the contact temperature sensor 13 in the verify check will be out of the specified range. In this case, the temperature detected by the front non-contact temperature sensor 12*f* is misidentified as an abnormal value, and an error is incorrectly reported.

Figure 10:
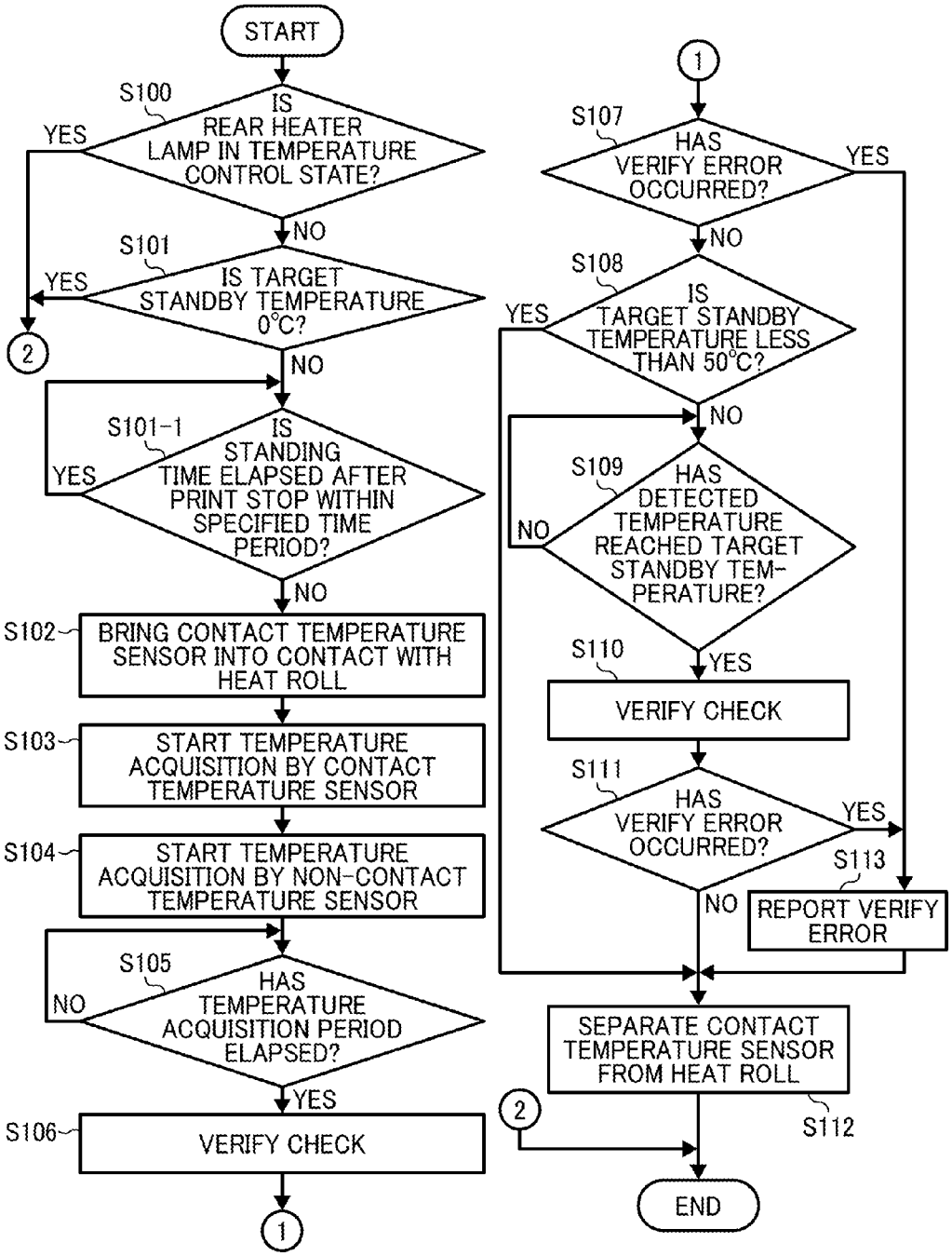
FIG. 10 is a flowchart illustrating a control of a verify check processing for non-contact temperature sensors, when a recording medium in use is narrow.

FIG. 10 is a flowchart illustrating a control of a verify check processing for the non-contact temperature sensors 12 for the upper heat roll 11U, when the recording medium W in use is narrow.

As the verify check processing is started, the condition of the rear heater lamp 14*r* is checked to determine whether to execute the verify check or not (S100). Referring to the step S100 in FIG. 10, "temperature control state" refers to a state in which output of the rear heater lamp 14*r* is under control based on the temperatures detected by the non-contact temperature sensors 12, which corresponds to the time period between C2 and C5 in FIG. 6. When the rear heater lamp 14*r* is in the temperature control state (Yes in S100), it means that the verify check has been already executed or now being executed. Thus, the verify check processing is terminated without executing the verify check.

When the rear heater lamp 14*r* is not in the temperature control state (No in S100), the target standby temperature T1 is checked to determine whether to execute the verify check or not (S101). In a case in which the drying device 140 conveys the recording medium W without heating the upper heat roll 11U to keep the upper heat roll 11U at normal temperature, the target standby temperature T1 is set to 0° C. through an input device (e.g., the operation panel OP).

Therefore, in a case in which the target standby temperature T1 is set to 0° C. (Yes in S101), the rear heater lamp 14*r* is not subject to temperature control, and the verify check processing is terminated.

When the target standby temperature T1 is not 0° C. (No in S101), a standing time period that is elapsed after the printing operation is stopped is checked to determine whether to execute the verify check or not (S101-1).

As illustrated in FIG. 9, when the recording medium W is narrow, there is a divergence in the surface temperature of the upper heat roll 11U between the rear and front sides immediately after the printing period. When the standing time period elapsed after the printing operation is stopped, counted by a standing time counter, has not reached a certain time period needed for evening out the temperatures of the front and rear sides (Yes in S101-1), the processing awaits until the standing time counter counts out (No in S101-1).

In Embodiment 1, the certain time period needed for evening out the temperatures of the front and rear sides (i.e., temperature evening period P4) is set to 5 minutes based on an evaluation result of an actual machine. The predetermined time period varies depending on the configuration of the drying mechanism 10, environmental temperature, etc., and is not limited thereto.

When the standing time counter has counted out (No in S101-1), the contact/separation motor 60 is driven to bring the contact temperature sensor 13 into contact with the upper heat roll 11U (S102), to execute the verify check of the non-contact temperature sensors 12.

The contact temperature sensor 13 then starts temperature acquisition (S103), and the non-contact temperature sensors 12 start temperature acquisition (S104). Next, whether a temperature acquisition period has been elapsed or not is checked (S105). When the temperature acquisition period has been elapsed (Yes in S105), temperature data detected by the contact temperature sensor 13 and the non-contact temperature sensors 12 (hereinafter "temperature detection data") is confirmed. When the temperature acquisition period has not been elapsed and any of the sensors are still detecting temperature (No in S105), the processing awaits until the temperature acquisition period has elapsed.

Since the contact temperature sensor 13 has a property of incapable of correctly detecting the temperature of a measurement target immediately after contacting the measurement target, the temperature acquisition period is set in accordance with the time constant of the sensor.

At the time when the temperature acquisition period is elapsed, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U.

Next, the first verify check is executed at the time C1 (S106). In the first verify check, the temperatures detected by the contact temperature sensor 13 and the rear non-contact temperature sensor 12*r*, both disposed at the rear side of the upper heat roll 11U in the axial direction, are compared with reference to the temperature detection data obtained in S105. Specifically, it is determined whether the difference between the temperatures detected by the contact temperature sensor 13 and the rear non-contact temperature sensor 12*r* is within the range of from −20° C. to +20° C.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

In Embodiment 1, in the verify check, it is confirmed that the non-contact temperature sensors 12*f* and 12*r* have detected correct temperatures when the difference between the temperatures detected by the non-contact temperature sensors 12*f* or 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

Next, whether a verify error has occurred or not is checked (S107). When an abnormality is detected in the comparison result made in the verify check of S106 (Yes in S107), a verify error is reported (S113).

When no abnormality is detected in the comparison result made in the verify check of S106 (No in S107), the target standby temperature T1 is checked (S108). In a case in which the target standby temperature T1 is less than 50° C. (Yes in S108), the second verify check is not executed at the time C2 when the temperature reaches the target standby temperature T1. In this case, the contact/separation motor 60 is driven to separate the contact temperature sensor 13 from the upper heat roll 11U (S112).

In the above case in which the target standby temperature T1 is less than 50° C., the detected temperature will not be different from normal temperature, since the difference between the temperatures detected by the contact temperature sensor 13 and the non-contact temperature sensors 12 is specified to be within a range of from −20° C. to +20° C. In this case, the second verify check is not executed since it will not be different from the first verify check executed in S106.

In Embodiment 1, whether to execute the verify check when the temperature has reached the target standby temperature T1 is determined based on the criteria that whether the target standby temperature T1 is less than 50° C. (T1<50° C.) or not. This criteria varies depending on the configuration of the drying mechanism 10, environmental temperature, etc., and is not limited thereto.

In a case in which the target standby temperature T1 is 50° C. or greater (No in S108), the second verify check is executed at the time C2 when the temperature reaches the target standby temperature T1. To execute the second verify check, whether or not the temperature detected by the rear non-contact temperature sensor 12*r* or the front non-contact temperature sensor 12*f* has reached the target standby temperature T1 is checked (S109). In a case in which neither of the temperatures detected by the rear non-contact temperature sensor 12*r* nor the front non-contact temperature sensor 12*f* has reached the target standby temperature T1 (No in S109), execution of the verify check is suspended until the detected temperature reaches the target standby temperature T1.

At the time C2 when the detected temperature reaches the target standby temperature T1, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U.

Since the contact temperature sensor 13 has a property of incapable of correctly detecting the temperature of a measurement target immediately after contacting the measurement target, a temperature acquisition period is generally needed in accordance with the time constant of the sensor. However, since the contact temperature sensor 13 is in contact with the upper heat roll 11U during the temperature raising state P1, there is no need to wait until the time period corresponding to the time constant of the sensor has elapsed.

In a case in which any of the rear non-contact temperature sensor 12*r* and the front non-contact temperature sensor 12*f* has reached the target standby temperature T1 (Yes in S109), the second verify check is executed (S110). In the second verify check, the temperatures detected by the contact temperature sensor 13 and the rear non-contact temperature sensor 12*r* are compared with reference to the temperature detection data obtained at the time C2. Specifically, it is determined whether the difference between the temperatures detected by the contact temperature sensor 13 and the rear non-contact temperature sensor 12*r* is within the range of from −20° C. to +20° C.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

Next, whether a verify error has occurred or not is checked (S111). When an abnormality is detected in the comparison result made in the second verify check of S110 (Yes in S111), a verify error is reported (S113).

When no abnormality is detected in the comparison result made in the second verify check of S110 (No in S111), the contact/separation motor 60 is driven to separate the contact temperature sensor 13 from the upper heat roll 11U (S112) to terminate the verify check. Thus, the verify check processing is terminated.

In the verify error reporting processing (S113), a verify error is reported to upper modules, such as the print controller 160 and the printer 120.

A verify error is detected in S107 or S111 when the difference between the temperatures detected by the front non-contact temperature sensor 12*f* or the rear non-contact temperature sensor 12*r* and the contact temperature sensor 13 is out of the specified range. In this case, it is recognized that the front non-contact temperature sensor 12*f* or the rear non-contact temperature sensor 12*r* has an abnormality. The verify error is reported to upper modules and all the heater lamps 14 and 15 are powered off. In addition, the contact/separation motor 60 is driven to separate the contact temperature sensor 13 from the upper heat roll 11U (S112).

The drying device 140 according to Embodiment 1 is configured to dry the long recording medium W supplied from the printer 120 being an inkjet printer. The drying device 140 includes the dancer mechanism 5 that applies a certain tension to the recording medium W, and the drying mechanism 10 that dries the recording medium W on which ink image is printed. The drying device 140 further includes the cooling mechanism 20 that cools the recording medium W having dried by heat, and the conveyance mechanism 30 that conveys the recording medium W from the drying device 140 toward the post-processor 150.

The drying mechanism 10 includes the multiple heat rolls 11 driven to rotate by the recording medium W being conveyed. The heat rolls 11 each internally contains the multiple heater lamps 14 or 15 serving as heat sources. The multiple non-contact temperature sensors 12 that detect the temperature of each heat roll 11 are provided, to control the temperature of the heat roll 11. In addition, the contact temperature sensor 13 that detects the temperature of each heat roll 11 by contact therewith is provided, to execute the verify check which determines if the temperatures detected by the non-contact temperature sensors 12 are abnormal or not. Moreover, the contact/separation motor 60 is provided that brings the contact temperature sensor 13 into contact with the heat roll 11 when the verify check is executed and separates the contact temperature sensor 13 from the heat roll 11 when the verify check is terminated.

The drying mechanism 10 further includes the thermal runaway sensor 16 that detects the heat roll 11 exceed the upper limit temperature, which may be caused by breakdown of the non-contact temperature sensors 12, and the width detection sensor 17 that detects the width of the recording medium W.

When the heat roll 11 is rotating, the contact temperature sensor 13 is separated from the heat roll 11. When the heat roll 11 is not rotating, the contact temperature sensor 13 is in contact with the heat roll 11. Thus, the contact temperature sensor 13 is prevented from being broken by friction with the surface of the heat roll 11, and the surface of the heat roll 11 is prevented from being damaged.

To control the front heater lamp 14*f* and the rear heater lamp 14*r*, symmetrically arranged within the upper heat roll 11U in the axial direction, to uniformly heat the upper heat roll 11U, the front non-contact temperature sensor 12*f* and the rear non-contact temperature sensor 12*r* are disposed at the front and rear end sides, respectively, of the upper heat roll 11U in the axial direction. In addition, the contact temperature sensor 13 disposed at the rear end side of the upper heat roll 11U in the axial direction executes the verify check of both the front non-contact temperature sensor 12*f* and the rear non-contact temperature sensor 12*r* disposed at the front and rear end sides, respectively, of the upper heat roll 11U in the axial direction.

One conventional heating device is known which includes a heat roll containing multiple heaters inside, multiple non-contact temperature sensors disposed along the axial direction of the heat roll facing the respective heaters, and the same number of multiple contact temperature sensors as the non-contact temperature sensors.

Generally, the heat roll is made of a material having a higher thermal conductivity than a heating target (e.g., paper). When the heating target is in a state of being conveyed, an unheated portion of the heating target successively reaches a contact position with the heat roll one after another. Thus, the temperature difference between the heat roll and the heating target is always large, which makes heat easily transfer from the heat roll to the heating target. Therefore, heat transfer efficiency within the heat roll is poor, causing a temperature unevenness on the surface of the heat roll.

In a case in which the outputs of the heaters are controlled based on the detected surface temperature of the heat roll, it is preferable that temperature detection is performed at multiple portions on the heat roll in the axial direction so as to accurately detect low-temperature or high-temperature portion on the heat roll in the axial direction.

In such a case in which multiple non-contact temperature sensors are disposed facing multiple portions on the heat roll in the axial direction, the surface temperature of the heat roll can be controlled at a high degree of accuracy by controlling the outputs of the heaters based on the detection results from the multiple non-contact temperature sensors.

However, there may be a case in which the outputs of the heaters cannot be appropriately controlled due to the occurrence of contamination of the non-contact temperature sensors with foreign substances or breakdown of the non-contact temperature sensors.

Whether the non-contact temperature sensors have an abnormality or not can be determined by comparing the temperature detected by the contact temperature sensor by contact with the heat roll and the temperature detected by the non-contact temperature sensors.

As described above, in view of the temperature unevenness on the surface of the heat roll, the detection position of the contact temperature sensor and that of the non-contact temperature sensor are brought close to each other as much as possible. There is a conventional heating device including the same number of multiple non-contact temperature sensors and contact temperature sensors, which is configured to bring the contact temperature sensors into contact with respective detection positions of the respective non-contact temperature sensors. However, it is impossible to make the detection position of the non-contact temperature sensor and that of the contact temperature sensor coincide with each other. Moreover, the detection positions of the non-contact temperature sensor and the contact temperature sensor may be arranged apart from each other for certain reasons regarding implement, such that a temperature difference is generated due to the temperature unevenness.

Even when the same number of non-contact temperature sensors and contact temperature sensors are provided, when the surface of the heat roll has a temperature unevenness, the temperatures detected by the non-contact temperature sensors and the contact temperature sensors cannot be properly compared unless the detected positions thereof are made coincide with each other. In other words, even when the same number of non-contact temperature sensors and contact temperature sensors are provided, no temperature unevenness should be caused on the surface of the heat roll, for proper temperature detection.

The inventors of the present invention have found that, when no temperature unevenness is caused on the surface of the heat roll, there is no need to bring the detection positions of the contact temperature sensor and the non-contact temperature sensor close to each other, and it is possible to confirm whether each of the multiple non-contact temperature sensors has an abnormality or not by using only one contact temperature sensor.

In the upper heating mechanism 40 according to Embodiment 1, the two non-contact temperature sensors 12*f* and 12*r* are installed at the front and rear end sides, respectively, of each upper heat roll 11U, and the contact temperature sensor 13 is disposed at the rear end side of the upper heat roll 11U. The detection position of the contact temperature sensor 13 in the axial direction is coincident with that of the rear non-contact temperature sensor 12*r*. The contact temperature sensor 13 can be brought into contact with or separated from the upper heat roll 11U by the contact/separation motor 60. The upper heating mechanism 40 is configured to execute the verify check for the multiple non-contact temperature sensors 12 by using one contact temperature sensor 13.

In the upper heating mechanism 40, the contact temperature sensor 13 disposed at the rear end side of the upper heat roll 11U executes a sensor abnormality check for both the front non-contact temperature sensor 12*f* and rear non-contact temperature sensor 12*r* disposed at the front and rear end sides, respectively, of the upper heat roll 11U. Therefore, the verify check is executed under a condition in which the rear-end surface temperature and the front-end surface temperature of the upper heat roll 11U are approximately the same.

Accordingly, the verify check is executed while conveyance of the recording medium W is suspended. When conveyance of the recording medium W is suspended, the recording medium W contacts the upper heat roll 11U at a fixed portion while generating a very small temperature difference between the recording medium W and the upper heat roll 11U. Owing to the small temperature difference, heat is more likely to transmit throughout the upper heat roll 11U than to transfer from the upper heat roll 11U to the recording medium W, thereby evening out the surface temperature unevenness of the upper heat roll 11U. As a result, the rear-end surface temperature and the front-end surface temperature of the upper heat roll 11U become approximately the same. It becomes possible to execute the verify check for the multiple non-contact temperature sensors 12 by using one contact temperature sensor 13 disposed at one end of the upper heat roll 11U.

In the case of heating the narrow recording medium W, heat may transfer to a part of the surface of the upper heat roll 11U which is not contacting the recording medium W and may release therefrom, thereby generating a temperature difference between the rear-side surface and the front-side surface of the upper heat roll 11U immediately after the printing operation is stopped. However, an experimental result of an actual machine indicates that, as illustrated in FIG. 9, the temperatures of both ends of the upper heat roll 11U become equal after a lapse of 5 minutes after the printing operation is stopped (i.e., at the time C7). Thus, even when the recording medium W is narrow, after a lapse of a certain time period, it becomes possible to execute the verify check for the multiple non-contact temperature sensors 12 by using one contact temperature sensor 13.

In the flowchart illustrated in FIG. 10, the verify check is executed when the following two conditions (1) and (2) are both satisfied.

(1) The target standby temperature T1 is not 0° C.

(2) The heaters remain powered off for 5 minutes or longer after a printing operation is stopped.

The verify check is executed at the time C1 when startup of the heaters is started and the time C2 when the surface temperature of the upper heat roll 11U reaches the target standby temperature T1.

In the verify check, the contact temperature sensor 13 installed at the rear end side of the upper heat roll 11U is brought into contact with the upper heat roll 11U. After a lapse of a certain period (i.e., the time constant of the sensor), the detection results from the contact temperature sensor 13 installed at the rear end side of the upper heat roll 11U and the non-contact temperature sensors 12 respectively installed at the rear and front end sides of the upper heat roll 11U are compared. When the difference between the detection results of the contact temperature sensor 13 and the non-contact temperature sensors 12 is not within the specified range, the non-contact temperature sensors 12 are determined to have an abnormality.

Thus, abnormal outputs, which may be caused by contamination of the non-contact temperature sensors 12 or breakdown of the non-contact temperature sensors 12 or the contact temperature sensor 13, can be properly detected. The occurrence of erroneous print output, which may be caused by the contamination or breakdown of the sensors, and undesired temperature rise, which may significantly damage the upper heating mechanism 40, can be prevented.

In the drying device 140 according to Embodiment 1, the two non-contact temperature sensors 12, respectively disposed at the rear and front sides, are subject to the verify check at the same time. Therefore, the calculator 51 serves as a conveyance speed information acquisition unit to acquire information on the conveyance speed of the recording medium W in the printer 120, from the controller of the printer 120 or the print controller 160. The timer controller 52 includes a standing time counter that measures a time elapsed from the time when the drying control of the drying device 140 is put into a standby mode, as well as the heater lamps 14 and 15 are put into a standby mode, based on the acquired conveyance speed information. A specified time period of 5 minutes is set after the drying control of the drying device 140 has stopped the printing operation before a next verify check is executed. This is because after a lapse of the specified time period (5 minutes) since the printing operation is stopped, the rear-side temperature and the front-side temperature of the upper heat roll 11U become equal. As the verify check is executed at the time when the temperature distribution in the upper heat roll 11U has become uniform, the detection accuracy is improved.

Modification 1

In Modification 1, whether or not to check the standing time period elapsed after the printing operation is stopped is determined based on the width of the recording medium W loaded on the drying device 140.

Figure 11:
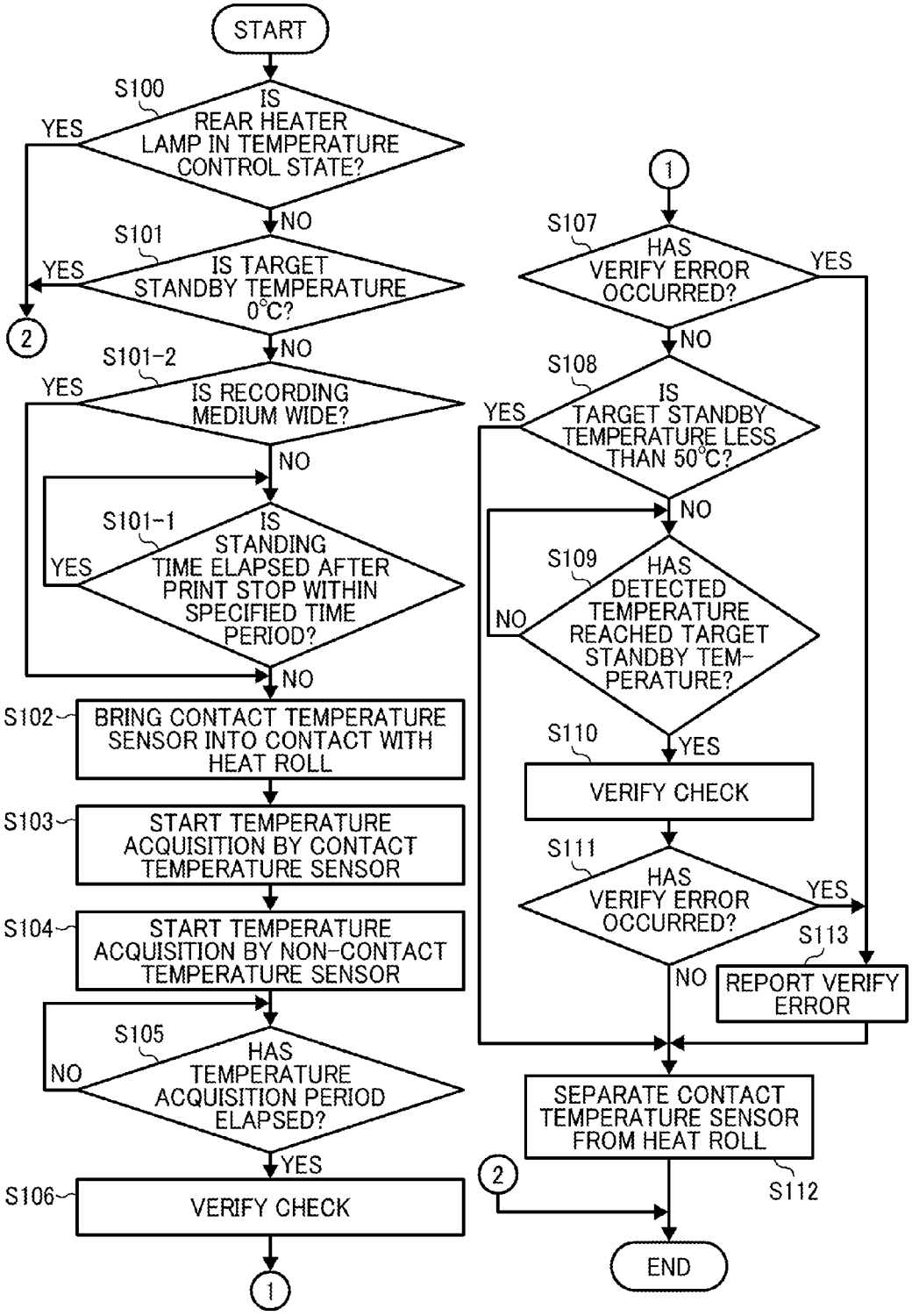
FIG. 11 is a flowchart illustrating a control of a verify check processing for non-contact temperature sensors for the upper heat roll according to another embodiment of the present invention.

FIG. 11 is a flowchart illustrating a control of a verify check processing for the non-contact temperature sensors 12 for the upper heat roll 11U according to Modification 1.

The processings in steps S100 and S101, in which the target standby temperature T1 is checked to determine whether to execute the verify check or not, are the same as those illustrated in FIG. 10. Therefore, explanation for the steps S100 and S101 is omitted. In a case in which the target standby temperature T1 is set to 0° C. (Yes in S101), the verify check processing is terminated in the same manner as in FIG. 10.

When the target standby temperature T1 is not 0° C. (No in S101), whether the recording medium W is wide or not is checked (S101-2), to determine whether or not to check the standing time period elapsed after the printing operation is stopped.

As illustrated in FIG. 7, when the recording medium W is wide, there is no divergence in the surface temperature of the upper heat roll 11U between the rear and front sides in the axial direction even immediately after the printing period. In this case, there is no need to check the standing time counter that measures the time elapsed after the printing operation is stopped.

Thus, in Modification 1, when the recording medium W is wide (Yes in S101-2), the contact temperature sensor 13 is brought into contact with the upper heat roll 11U (S102) without checking the standing time counter (S101-1).

When the recording medium W is narrow (No in S101-2), the standing time period elapsed after the printing operation is stopped is checked to determine whether to execute the verify check or not (S101-1).

The processing awaits until the standing time counter counts out (No in S101-1) in the similar manner as in FIG. 10.

When the standing time counter has counted out (No in S101-1), the contact/separation motor 60 is driven to bring the contact temperature sensor 13 into contact with the upper heat roll 11U (S102), to execute the verify check of the non-contact temperature sensors 12.

The processings in steps S102 through S113 in FIG. 11 are the same as those illustrated in FIG. 10. Therefore, explanation for the steps S102 through S113 is omitted.

The drying device 140 includes the width detection sensor 17 that detects the width of the recording medium W. In Modification 1, when the recording medium W loaded on the drying mechanism 10 is determined to be wide based on a signal obtained from the width detection sensor 17, the verify check is executed without measuring the time elapsed after the printing operation is stopped. In Modification 1, the width of the recording medium W is determined and, only when the recording medium W is narrow, the certain time period is allowed to pass before execution of the verify check. Thus, Modification 1 can improve the throughput when the recording medium W is wide.

Modification 2

In Modification 2, whether or not to check the standing time period elapsed after the printing operation is stopped is determined based on the difference between the temperatures detected at the front and rear sides of the upper heat roll 11U.

Figure 12:
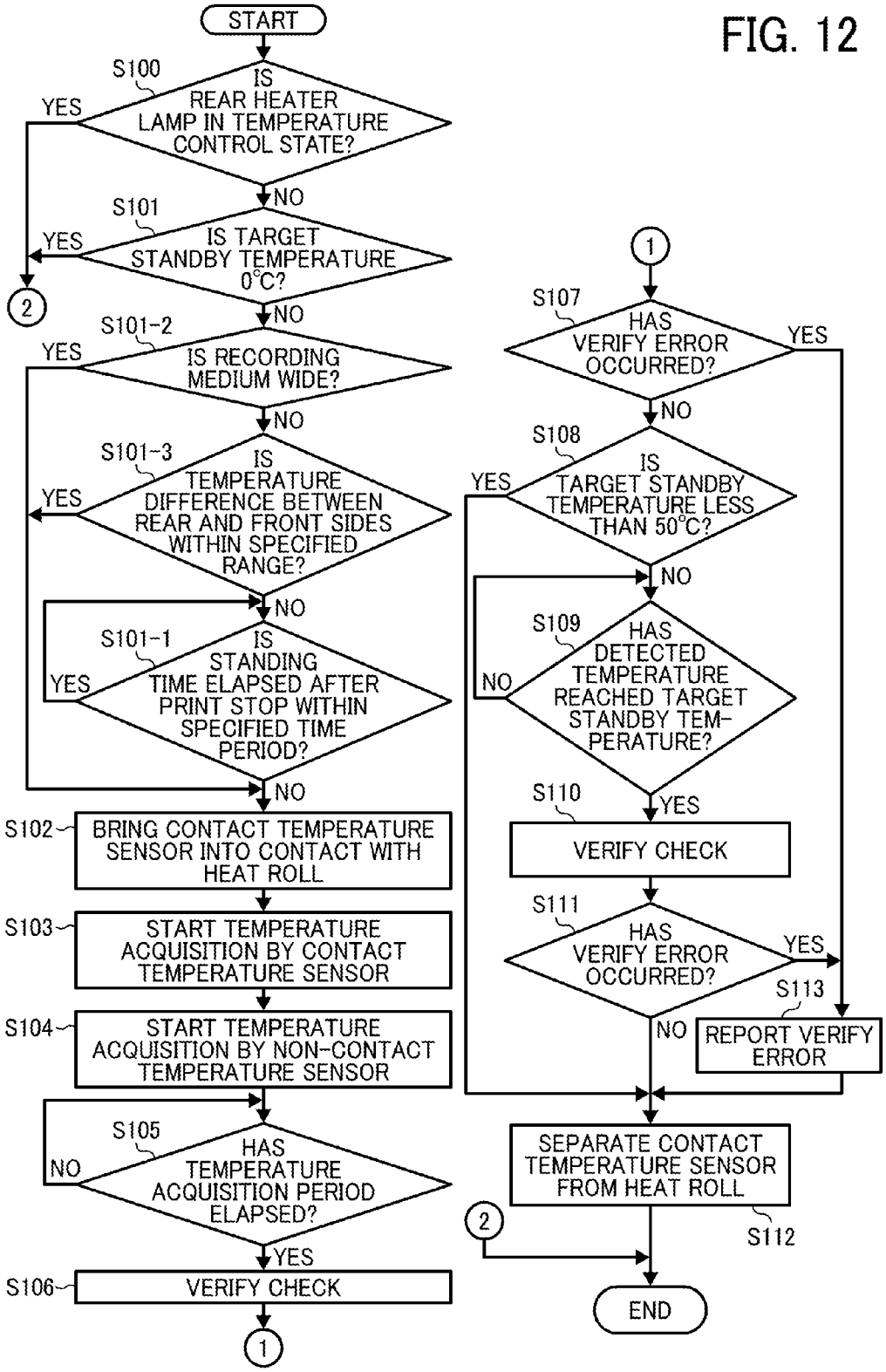
FIG. 12 is a flowchart illustrating a control of a verify check processing for non-contact temperature sensors for the upper heat roll according to another embodiment of the present invention.

FIG. 12 is a flowchart illustrating a control for a verify check processing for the non-contact temperature sensors 12 for the upper heat roll 11U according to Modification 2.

The processings in steps S100 and S101, in which the target standby temperature T1 is checked to determine whether to execute the verify check or not, are the same as those illustrated in FIG. 10. Therefore, explanation for the steps S100 and S101 is omitted. In a case in which the target standby temperature T1 is set to 0° C. (Yes in S101), the verify check processing is terminated in the same manner as in FIG. 10.

When the target standby temperature T1 is not 0° C. (No in S101), whether the recording medium W is wide or not is checked (S101-2) in the same manner as in Modification 1.

When the recording medium W loaded on the drying device 140 is wide (Yes in S101-2), the contact temperature sensor 13 is brought into contact with the upper heat roll 11U (S102) without checking the standing time counter (S101-1).

When the recording medium W is narrow (No in S101-2), whether the difference between the temperatures detected at the front and rear sides of the upper heat roll 11U is within the specified range or not is determined (S101-3), to determine whether or not to check the standing time period elapsed after the printing operation is stopped.

The graph of FIG. 9 is illustrated based on a supposition that the recording medium W has a possible minimum width. In a case in which the width of the recording medium W is determined to be narrow based on a detection result from the width detection sensor 17 but is close to that of the wide recording medium W, the front-side surface area of the upper heat roll 11U from which heat is continuously released becomes smaller. Thus, the temperature evening period P4 becomes shorter than that illustrated in FIG. 9.

In Modification 2, for the purpose of improving the throughput, the difference between the temperatures detected by the rear non-contact temperature sensor 12*r* and the front non-contact temperature sensor 12*f* is calculated.

When the temperature difference is within the specified range (Yes in S101-3), it is determined that the temperature unevenness caused in the upper heat roll 11U has been eliminated. In this case, the contact temperature sensor 13 is brought into contact with the upper heat roll 11U (S102) without checking the standing time counter (S101-1), to execute the verify check.

When the temperature difference is out of the specified range (No in S101-3), it is determined that the temperature unevenness caused in the upper heat roll 11U has not been eliminated, and the standing time period elapsed after the printing operation is stopped is checked to determine whether to execute the verify check or not (S101-1).

The processing awaits until the standing time counter counts out (No in S101-1) in the similar manner as in FIG. 10.

When the standing time counter has counted out (No in S101-1), the contact/separation motor 60 is driven to bring the contact temperature sensor 13 into contact with the upper heat roll 11U (S102), to execute the verify check of the non-contact temperature sensors 12.

The processings in steps S102 through S113 in FIG. 12 are the same as those illustrated in FIG. 10. Therefore, explanation for the steps S102 through S113 is omitted.

In the drying device 140 according to Modification 2, the calculator 51 recognizes a temperature difference between the rear and front sides of the upper heat roll 11U based on temperature data obtained from the non-contact temperature sensors 12 respectively disposed at the rear and front sides of the upper heat roll 11U. When the temperature difference between the rear and front sides of the upper heat roll 11U is determined to be within the specified range, the verify check is executed without measuring the time elapsed after the printing operation is stopped. In Modification 2, the temperature difference between the rear and front sides of the upper heat roll 11U is within the specified range, it is determined that the rear-side and front-side temperatures of the upper heat roll 11U have become equal. Thus, Modification 2 can improve the throughput even when the recording medium W is narrow.

Modification 3

In Modification 3, one of the non-contact temperature sensors 12 for executing the verify check is selected based on the standing time period elapsed after the printing operation is stopped.

Figure 13A:
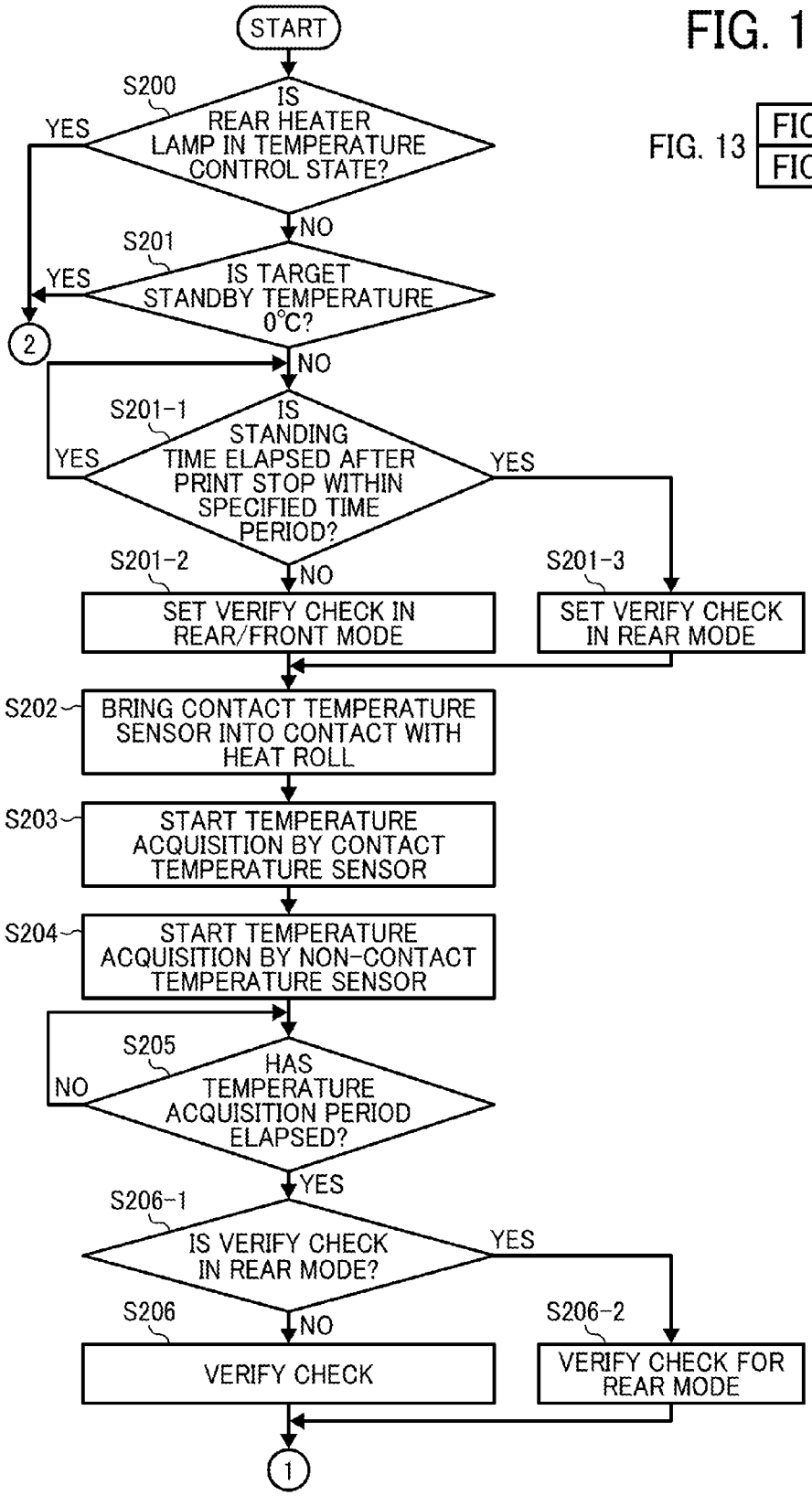
FIGS. 13A and 13B are flowcharts illustrating a control of a verify check processing for non-contact temperature sensors for the upper heat roll according to another embodiment of the present invention.
Figure 13B:
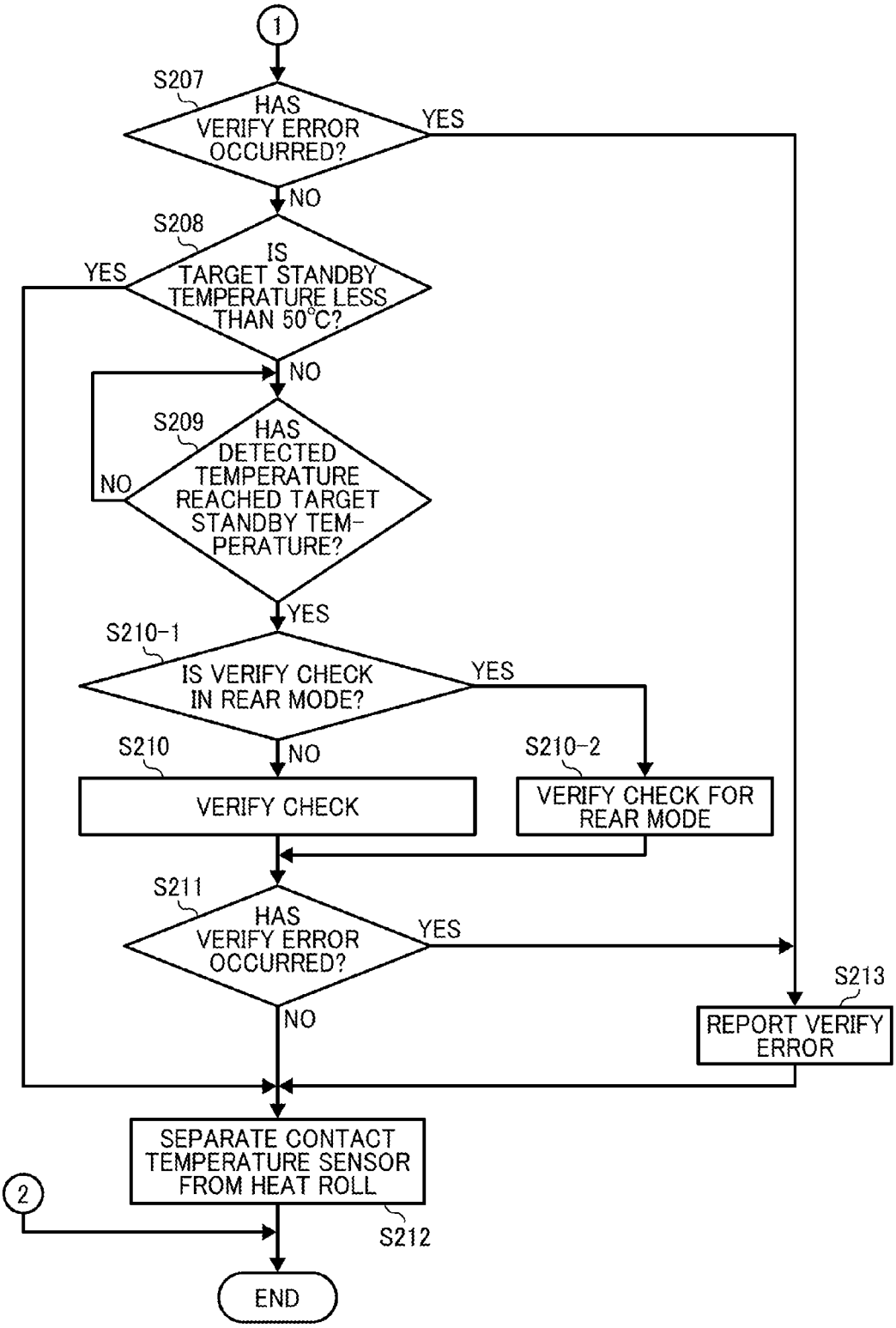

FIG. 13 is a flowchart illustrating a control of a verify check processing for the non-contact temperature sensors 12 for the upper heat roll 11U according to Modification 3.

In the flowchart illustrated in FIG. 10, execution of the verify check is suspended until the standing time counter, counting the time elapsed after the printing operation is stopped, counts out (i.e., until the standing time counter detects that the temperature evening period P4 has elapsed). In this embodiment, there is a possibility that the throughput is disadvantageously worsen.

In a case in which there is a divergence in the surface temperature of the upper heat roll 11U between the rear and front sides at the time when the first verify check is executed, it means that startup of the heaters has been executed immediately after the printing operation is stopped. Therefore, it means that the verify check is executed more than one time before execution of the printing operation immediately before re-startup of the heaters. Thus, in Modification 3, the output from the front non-contact temperature sensor 12*f* is assumed to be correct, and only the rear non-contact temperature sensor 12*r* is subjected to the verify check, thereby suppressing a decrease in throughput as much as possible.

As the verify check processing is started, the condition of the rear heater lamp 14*r* is checked to determine whether to execute the verify check or not (S200). When the rear heater lamp 14*r* is in the temperature control state (Yes in S200), it means that the verify check has been already executed or now being executed. Thus, the verify check processing is terminated without executing the verify check.

When the rear heater lamp 14*r* is not in the temperature control state (No in S200), the target standby temperature T1 is checked to determine whether to execute the verify check or not (S201). In a case in which the drying device 140 conveys the recording medium W without heating the upper heat roll 11U to keep the upper heat roll 11U at normal temperature, the target standby temperature T1 is set to 0° C. through an input device (e.g., the operation panel OP).

Therefore, in a case in which the target standby temperature T1 is set to 0° C. (Yes in S201), the rear heater lamp 14*r* is not subject to temperature control, and the verify check processing is terminated.

When the target standby temperature T1 is not 0° C. (No in S201), the standing time period elapsed after the printing operation is stopped is checked, and an execution mode of the verify check is set (S201-2).

As illustrated in FIG. 9, when the recording medium W is narrow, there is a divergence in the surface temperature of the upper heat roll 11U between the rear and front sides immediately after the printing period.

When the standing time period elapsed after the printing operation is stopped has not reached a certain time period needed for eliminating the temperature difference between the front and rear sides (Yes in S201-1), the verify check is set in a rear mode (S201-3). In the rear mode, the front non-contact temperature sensor 12*f* is not subject to the verify check, and only the rear non-contact temperature sensor 12*r* is subject to the verify check.

When the standing time period elapsed after the printing operation is stopped has reached a certain time period needed for eliminating the temperature difference between the front and rear sides (No in S201-1), the verify check is set in a rear/front mode (S201-2). In the rear/front mode, both the front non-contact temperature sensor 12*f* and the rear non-contact temperature sensor 12*r* are subject to the verify check.

When the verify check is set in either the rear mode or the rear/front mode (S201-2 or S201-3), the contact/separation motor 60 is driven to bring the contact temperature sensor 13 into contact with the upper heat roll 11U (S202), to execute the verify check of the non-contact temperature sensors 12.

The contact temperature sensor 13 then starts temperature acquisition (S203), and the non-contact temperature sensors 12 start temperature acquisition (S204). Next, whether a temperature acquisition period has been elapsed or not is checked (S205). When the temperature acquisition period has been elapsed (Yes in S205), temperature data detected by the contact temperature sensor 13 and the non-contact temperature sensors 12 (hereinafter "temperature detection data") is confirmed. When the temperature acquisition period has not been elapsed and any of the sensors are still detecting temperature (No in S205), the processing awaits until the temperature acquisition period has elapsed.

Since the contact temperature sensor 13 has a property of incapable of correctly detecting the temperature of a measurement target immediately after contacting the measurement target, the temperature acquisition period is set in accordance with the time constant of the sensor.

At the time when the temperature acquisition period is elapsed, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U.

Next, to execute the first verify check at the time C1, the execution mode of the verify check is checked (S206-1).

When the execution mode of the verify check is set in the rear/front mode (No in S206-1), the normal verify check is executed (S206).

In the first normal verify check, the temperatures detected by the contact temperature sensor 13 and the rear non-contact temperature sensor 12*r* are compared with reference to the temperature detection data obtained in S205. Specifically, it is determined whether the difference between the temperatures detected by the contact temperature sensor 13 and the rear non-contact temperature sensor 12*r* is within the range of from −20° C. to +20° C.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

In Modification 3, in the verify check, it is confirmed that the non-contact temperature sensors 12*f* and 12*r* have detected correct temperatures when the difference between the temperatures detected by the non-contact temperature sensors 12*f* or 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

When the execution mode of the verify check is set in the rear mode (Yes in S206-1), a verify check for the rear mode is executed (S206-2). In the first verify check for the rear mode, the temperatures detected by the contact temperature sensor 13 and the rear non-contact temperature sensor 12*r* are compared with reference to the temperature detection data obtained in S205. Specifically, it is determined whether the difference between the temperatures detected by the contact temperature sensor 13 and the rear non-contact temperature sensor 12*r* is within the range of from −20° C. to +20° C.

In Modification 3, in the verify check for the rear mode, it is confirmed that the rear non-contact temperature sensor 12*r* has detected correct temperatures when the difference between the temperatures detected by the rear non-contact temperature sensor 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

Next, whether a verify error has occurred or not is checked (S207). When an abnormality is detected in the comparison result made in the verify check of S206 or S206-2 (Yes in S207), a verify error is reported (S213).

When no abnormality is detected in the comparison result made in the verify check of S206 or S206-2 (No in S207), the target standby temperature T1 is checked (S208).

In a case in which the target standby temperature T1 is less than 50° C. (Yes in S208), the second verify check is not executed at the time C2 when the temperature reaches the target standby temperature T1. In this case, the contact/separation motor 60 is driven to separate the contact temperature sensor 13 from the upper heat roll 11U (S212).

In the above case in which the target standby temperature T1 is less than 50° C., since the difference between the temperatures detected by the contact temperature sensor 13 and the non-contact temperature sensors 12 is specified to be within a range of from −20° C. to +20° C., the detected temperature will not be different from normal temperature. In this case, the second verify check is not executed since it will not be different from the first verify check executed in S206, and the contact temperature sensor 13 is separated from the upper heat roll 11U (S121) to terminate the verify check processing.

In the present embodiment, whether or not to execute the verify check when the temperature has reached the target standby temperature T1 is determined based on the criteria that whether the target standby temperature T1 is less than 50° C. (T1<50° C.) or not. This criterion varies depending on the configuration of the drying mechanism 10, environmental temperature, etc., and is not limited thereto.

In a case in which the target standby temperature T1 is 50° C. or greater (No in S208), the second verify check is executed at the time C2 when the temperature reaches the target standby temperature T1. To execute the second verify check, whether or not the temperature detected by the rear non-contact temperature sensor 12*r* has reached the target standby temperature T1 is checked (S209). In a case in which the temperature detected by the rear non-contact temperature sensor 12*r* has not reached the target standby temperature T1 (No in S209), execution of the verify check is suspended until the detected temperature reaches the target standby temperature T1.

At the time C2 when the detected temperature reaches the target standby temperature T1, with respect to the upper heat roll 11U, the contact temperature sensor 13 and the rear non-contact temperature sensor 12*r*, both disposed at the rear side of the upper heat roll 11U in the axial direction, execute detection of the temperature of the rear-side surface of the upper heat roll 11U in the axial direction. At the same time, the front non-contact temperature sensor 12*f*, disposed at the front side of the upper heat roll 11U in the axial direction, executes detection of the temperature of the front-side surface of the upper heat roll 11U.

Since the contact temperature sensor 13 has a property of incapable of correctly detecting the temperature of a measurement target immediately after contacting the measurement target, a temperature acquisition period is generally needed in accordance with the time constant of the sensor. However, since the contact temperature sensor 13 is in contact with the upper heat roll 11U during the temperature raising state P1, there is no need to wait until the time period corresponding to the time constant of the sensor has elapsed.

In a case in which the temperature detected by the rear non-contact temperature sensor 12*r* has reached the target standby temperature T1 (Yes in S209), the execution mode of the verify check is checked (S210-1).

When the execution mode of the verify check is set in the rear/front mode (No in S210-1), the second normal verify check is executed (S210).

In the second normal verify check, the temperatures detected by the contact temperature sensor 13 and the rear non-contact temperature sensor 12*r*, both disposed at the rear side of the upper heat roll 11U in the axial direction, are compared with reference to the temperature detection data obtained at the time C2. Specifically, it is determined whether the difference between the temperatures detected by the contact temperature sensor 13 and the rear non-contact temperature sensor 12*r* is within the range of from −20° C. to +20° C.

In addition, with respect to the upper heat roll 11U, the temperatures detected by the contact temperature sensor 13 and the front non-contact temperature sensor 12*f*, respectively disposed at the rear side and the front side of the upper heat roll 11U in the axial direction, are also compared. Specifically, it is determined whether the difference between the temperatures detected by the contact temperature sensor 13 and the front non-contact temperature sensor 12*f* is within the range of from −20° C. to +20° C.

In Modification 3, in the verify check, it is confirmed that the non-contact temperature sensors 12*f* and 12*r* have detected correct temperatures when the difference between the temperatures detected by the non-contact temperature sensors 12*f* or 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

When the execution mode of the verify check is set in the rear mode (Yes in S210-1), the second verify check for the rear mode is executed (S210-2). In the second verify check for the rear mode, the temperatures detected by the contact temperature sensor 13 and the rear non-contact temperature sensor 12*r* are compared with reference to the temperature detection data obtained at the time C2. Specifically, it is determined whether the difference between the temperatures detected by the contact temperature sensor 13 and the rear non-contact temperature sensor 12*r* is within the range of from −20° C. to +20° C.

In Modification 3, in the verify check for the rear mode, it is confirmed that the rear non-contact temperature sensor 12*r* has detected correct temperatures when the difference between the temperatures detected by the rear non-contact temperature sensor 12*r* and the contact temperature sensor 13 is within the specified range of from −20° C. to +20° C. This specified range is determined based on an experimental result from an actual machine. The specified range varies depending on the configuration of the drying mechanism 10, environmental temperature, etc., and is not limited to the above-described range.

Next, whether a verify error has occurred or not is checked (S211). When an abnormality is detected in the comparison result made in the second verify check of S210 or S210-2 (Yes in S211), a verify error is reported (S213).

When no abnormality is detected in the comparison result made in the second verify check of S210 or S210-2 (No in S211), the contact/separation motor 60 is driven to separate the contact temperature sensor 13 from the upper heat roll 11U (S212) to terminate the verify check, and the verify check processing is terminated.

In the verify error reporting processing (S213), a verify error is reported to upper modules, such as the print controller 160 and the printer 120.

A verify error is detected in S207 or S211 when the difference between the temperatures detected by the front non-contact temperature sensor 12*f* or the rear non-contact temperature sensor 12*r* and the contact temperature sensor 13 is out of the specified range. In this case, it is recognized that the front non-contact temperature sensor 12*f* or the rear non-contact temperature sensor 12*r* has an abnormality. The verify error is reported to upper modules and all the heater lamps 14 and 15 are powered off. In addition, the contact/separation motor 60 is driven to separate the contact temperature sensor 13 from the upper heat roll 11U (S212).

In Modification 3, the calculator 51, included in the upper heating mechanism 40, selects one of the non-contact temperature sensors 12 for executing the verify check, based on whether or not the certain time period has elapsed after the printing operation is stopped before the next verify check. Even when the certain time period has not yet been elapsed, the verify check for the rear non-contact temperature sensor 12*r* is preferentially executed, thereby improving the throughput.

In a case in which the rear-side and front-side temperatures of the upper heat roll 11U are not equal, the recording medium W is always narrow. When the recording medium W is narrow, there is a case in which temperature control is performed only by the rear heater lamp 14*r* without using the front heater lamp 14*f*. When the temperature control is performed only by the rear heater lamp 14*r*, the rear non-contact temperature sensor 12*r* is preferentially subject to the verify check, thus improving the throughput when the recording medium W is narrow.

When the target printing temperature T2 is changed, the temperature difference between the rear and front sides of the upper heat roll 11U, generated after the printing operation on the narrow recording medium W, is also changed. As the temperature difference is changed, the specified time period needed for evening out the temperature unevenness on the upper heat roll 11U after the printing operation is stopped (i.e., temperature evening period P4) is also changed. Therefore, when the target printing temperature T2 is set through an input device such as the print controller 160 and the operation panel OP, data regarding the specified time period (i.e., temperature evening period P4), from when the printing operation is stopped until the next verify check becomes executable, may be changed in accordance with the set target printing temperature T2.

As the specified time period is changed in accordance with the set target printing temperature T2, the temperature evening period P4 can be properly set considering an influence of the temperature difference between the rear and front sides of the upper heat roll 11U that is also changed in accordance with the target printing temperature T2. Thus, even in a case of drying the narrow recording medium W that needs to wait until the temperature evening period P4 has elapsed after the printing operation is stopped, the target printing temperature T2 can be shortened in accordance with the target printing temperature T2, thereby improving the throughput.

When environmental conditions such as outside air temperature and humidity are changed, the temperature difference between the rear and front sides of the upper heat roll 11U, generated after the printing operation on the narrow recording medium W, is also changed. As the temperature difference is changed, the specified time period needed for evening out the temperature unevenness on the upper heat roll 11U after the printing operation is stopped (i.e., temperature evening period P4) is also changed. Therefore, when environmental conditions are input through an input device such as the print controller 160 and the operation panel OP, data regarding the specified time period (i.e., temperature evening period P4), from when the printing operation is stopped until the next verify check becomes executable, may be changed in accordance with the input environmental conditions.

In this case, a maintainer or operator H can change the data regarding the specified time period, from when the printing operation is stopped until the next verify check becomes executable, through the input device. Thus, an influence of the environmental conditions such as outside air temperature and humidity can be minimized, thereby improving detection accuracy of the verify check.

Temperature responsiveness is variable depending on the types of the temperature sensors 12 and 13 and the heat roll 11. Therefore, data regarding the specified temperature difference range (e.g., from −20° C. to +20° C.), for determining correctness in temperature detection by the non-contact temperature sensors 12*r* and 12*f* in the verify check, may be changed through an input device such as the print controller 160 and the operation panel OP.

In this case, a maintainer or operator H can change the data regarding the specified temperature difference range for determining correctness in temperature detection by the non-contact temperature sensors 12*r* and 12*f* in the verify check, through the input device. Thus, an influence of device conditions, such as the types of the temperature sensors 12 and 13 and the heat roll 11, can be minimized, thereby improving detection accuracy of the verify check.

When the specified temperature difference range (e.g., from −20° C. to +20° C.), for determining correctness in temperature detection by the non-contact temperature sensors 12*r* and 12*f* in the verify check, is changed, the condition of the target standby temperature T1 in determining whether or not to execute the second verify check is also changed. Therefore, data regarding the condition of the target standby temperature T1 (e.g., 50° C.) in determining whether or not to execute the second verify check may be changed through an input device such as the print controller 160 and the operation panel OP.

In this case, a maintainer or operator H can change the data regarding the condition of the target standby temperature T1 in determining whether or not to execute the second verify check, through the input device. Thus, the temperature condition for executing the verify check can be varies and an influence of the environmental conditions and device conditions can be minimized, thereby improving detection accuracy of the verify check.

As described above, Embodiment 1 relates to the image forming system 500 including the printer 120 (image forming device) and the drying device 140. According another embodiment, an image forming device and a drying device is included in a single casing to provide an image forming apparatus. In this case, the drying device includes the above-described upper heating mechanism 40.

Embodiment 2

In Embodiment 1, the image forming system 500 includes the heating device that dries an ink applied onto the recording medium W. According to another embodiment, the heating device may be included in a fixing device included in an electrophotographic image forming apparatus, for fixing a toner image on a recording medium.

In Embodiment 2, the heating device according to an embodiment of the present invention is applied to a fixing device included in an electrophotographic image forming apparatus.

Figure 14:
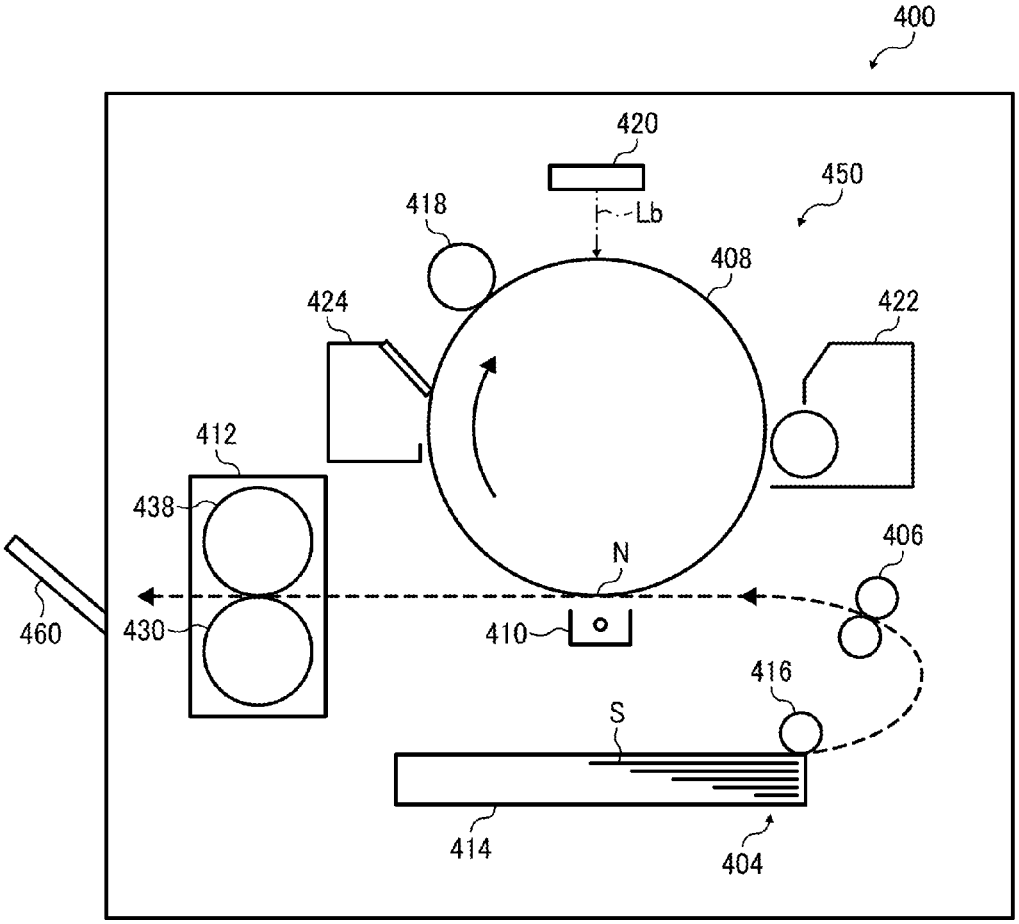
FIG. 14 is a schematic view of an image forming apparatus according to an embodiment of the present invention.

FIG. 14 is a schematic view of an image forming apparatus 400 according to an embodiment of the present invention (hereinafter "Embodiment 2").

The image forming apparatus 400 includes a sheet feeder 404, a registration roller pair 406, a photoconductor 408 serving as a latent image bearer, a transfer device 410, and a fixing device 412.

The sheet feeder 404 includes a sheet feeding tray 414 and a sheet feeding roller 416. The sheet feeding tray 414 stores stacked sheets S of a recording medium. The sheet feeding roller 416 separates and feeds the sheets S stacked in the sheet feeding tray 414 one by one.

The sheet S is fed by the sheet feeding roller 416 and once stopped by the registration roller pair 406. The registration roller pair 406 feeds the sheet S to a transfer position N when the leading end of a toner image formed on the photoconductor 408 coincides with a predetermined position on the leading end part of the sheet S in the conveyance direction.

A charging roller 418, an irradiator 420, a developing device 422, the transfer device 410, and a cleaner 424, in this order, are disposed around the photoconductor 408 in the rotation direction thereof, forming an image forming unit 450. The irradiator 420 emits exposure light Lb to a surface of the photoconductor 408 between the charging roller 418 and the developing device 422. The exposure light Lb scan the photoconductor 408.

In the image forming unit 450, as the photoconductor 408 starts rotating, the charging roller 418 uniformly charges the surface of the photoconductor 408 and the irradiator 420 emits the exposure light Lb to the charged surface based on image data, thus forming a latent image on the photoconductor 408. As the photoconductor 408 rotates, the latent image is conveyed to a position where the photoconductor 408 faces the developing device 422. The developing device 422 supplies toner to the latent image to form a toner image that is visible.

The toner image is transferred from the photoconductor 408 onto the sheet S by a transfer bias applied from the transfer device 410, in synchronization with an entry of the sheet S to the transfer position N.

The sheet S having the toner image thereon is conveyed to the fixing device 412. The fixing device fixes the toner image on the sheet S. The sheet S having the fixed toner image thereon is discharged onto an output tray 460.

Residual toner particles remaining on the photoconductor 408 after passing through the transfer position N are conveyed to the cleaner 424, as the photoconductor 408 rotates. The cleaner 424 removes the residual toner particles to clean the surface of the photoconductor 408. A residual potential remaining in the photoconductor 408 is removed by a neutralizer. The photoconductor 408 gets ready for the next image forming process.

The fixing device 412 includes a heating roller 438 and a pressing roller 430. The fixing device fixes the toner image on the sheet S by heat and pressure. The fixing device 412 further includes the upper heating mechanism 40, used for heating the upper heat roll 11U in Embodiment 1, for heating the heating roller 438.

Thus, in the fixing device 412, the temperature of the heating roller 438 serving as a heating member, is detected by multiple non-contact temperature sensors 12, and whether or not the non-contact temperature sensors 12 have an abnormality or not is determined by the contact temperature sensor 13. The fixing device 412 can be composed of a reduced number of assemblies. The image forming apparatus 400 including the fixing device 412 can be also composed of a reduced number of assemblies.

The image forming apparatus 400 has a configuration in which a toner image on a single photoconductor 408 is directly transferred onto the sheet S. Alternatively, the image forming apparatus may have a configuration in which multiple toner images formed on multiple photoconductors are directly transferred onto a sheet either directly or via an intermediate transferor.

Embodiment A

Embodiment A relates to a heating device including: a heating member (e.g., upper heat roll 11U) to contact a heating target (e.g., recording medium W) being conveyed; a heat source (e.g., front heater lamp 14*f*, rear heater lamp 14*r*) to supply heat to the heating member; a plurality of non-contact temperature detectors (e.g., rear non-contact temperature sensor 12*r*, front non-contact temperature sensor 120, each of which to detect a first temperature of the heating member without contacting the heating member; a contact temperature detector (e.g., contact temperature sensor 13) to detect a second temperature of the heating member by contact with the heating member; a heat source drive controller (e.g., heater controller 50) to control drive of the heat source based on the first temperatures detected by the non-contact temperature detectors; and a temperature detection abnormality detector (e.g., calculator 51) to perform a determination on whether each one of the non-contact temperature detectors has an abnormality or not while the heating target is not conveyed, by comparing the first temperature detected by the one of the non-contact temperature detectors and the second temperature detected by the contact temperature detector.

According to Embodiment A, as described in Embodiment 1, the plurality of non-contact temperature detectors detect temperature of the heating member and the contact temperature detector determines whether or not the non-contact temperature detectors have an abnormality. The heating device can be composed of a reduced number of assemblies. The reason for this is considered as follows.

When the heating target is being conveyed, an unheated portion of the heating target successively reaches a contact position with the heating member one after another. Thus, the temperature difference between the heating member and the heating target is always large, which makes heat easily transfer from the heating member to the heating target. Therefore, heat transfer efficiency within the heating member is poor, easily causing a temperature unevenness on the surface of the heating member. In this situation, there may be a case in which one portion on the surface has reached a certain temperature but another portion has not reached the certain temperature. If temperature detection is performed at only one portion on the surface, drive control of the heat source cannot be properly performed based on the temperatures detected by the temperature detectors. According to Embodiment A, the heating device includes multiple non-contact temperature detectors, and the heat source drive controller properly controls drive of the heat source based on the temperatures detected by the non-contact temperature detectors.

According to Embodiment A, whether or not the non-contact temperature detectors have an abnormality or not is determined based on the temperatures detected by the non-contact temperature detectors and the contact temperature detector. In this embodiment, when the difference between the temperatures detected by the non-contact temperature detector and the contact temperature detector is out of a specified range, the non-contact temperature detector is determined to have an abnormality, under an assumption that the detection position of the non-contact temperature detector and that of the contact temperature detector on the surface of the heating member have approximately the same temperature. If there is a temperature difference between the detection position of the non-contact temperature detector and that of the contact temperature detector, detected temperatures cannot be properly compared. In a case in which the surface of the heating member has a temperature unevenness, as the distance between the detection position of the non-contact temperature detector and that of the contact temperature detector becomes larger, a temperature difference therebetween becomes larger, and therefore the detected temperatures cannot be properly compared. A related-art heating device is known which includes the same number of multiple non-contact temperature detectors and contact temperature detectors. The detected position of each of the contact temperature detectors and that of each of the non-contact temperature detectors are arranged close to each other. As the detected positions are close to each other, a temperature difference between the detected positions, which may be cause due to a temperature unevenness, is suppressed. However, using the same number of the non-contact temperature detectors and the contact temperature detectors, for determining whether or not the non-contact temperature detectors have an abnormality, increases the number of assemblies composing the heating device.

In Embodiment A, two or more non-contact temperature detectors and one contact temperature detector perform temperature detection when conveyance of the heating target is suspended.

When conveyance of the heating target is suspended, the heating target may be either out of contact with or in contact with the heating member.

In a case in which the heating target is out of contact with the heating member, there is no target to which heat can transfer from the heating member. Thus, heat transfer efficiency is increased within the heating member and the temperature unevenness on the surface of the heating member is evened out.

In a case in which the heating target is in contact with the heating member, the heating target is in contact with the heating member at a fixed portion. Thus, the temperature difference between the heating member and the heating target is small and heat is unlikely to transfer from the heating member to the heating target. Thus, heat transfer efficiency is increased within the heating member and the temperature unevenness on the surface of the heating member is evened out.

In Embodiment A, the non-contact temperature detectors and the contact temperature detector perform temperature detection when conveyance of the heating target is suspended. This means that the temperature detection is performed when the surface of the heating member has no temperature unevenness. In this case in which the surface of the heating member has no temperature unevenness, there is no need to bring the detection position of the contact temperature detector close to the detection position of each of the non-contact temperature detectors. Accordingly, it is possible to determine whether each one of the multiple non-contact temperature detectors has an abnormality or not by comparing the temperatures detected by the single contact temperature detector and each one of the multiple non-contact temperature detectors. Thus, in the present embodiment, the number of contact temperature detector is smaller than that of non-contact temperature detectors. The total number of assemblies has been reduced than that of the related-art heating device including the same number of non-contact temperature detectors and contact temperature detectors.

Embodiment B

Embodiment B relates to the heating device according to Embodiment A in which the temperature detection abnormality detector (e.g., calculator 51) performs the determination on whether each one of the non-contact temperature detectors (e.g., rear non-contact temperature sensor 12*r*, front non-contact temperature sensor 120 has an abnormality or not at a time when a certain time period (e.g., 5 minutes) has elapsed after conveyance of the heating target (e.g., recording medium W) is stopped.

According to Embodiment B, as described in Embodiment 1, the determination on whether each one of the non-contact temperature detectors has an abnormality or not is performed based on the detection results obtained when the surface temperature distribution of the heating member (e.g., upper heat roll 11U) is uniform. Thus, the detection accuracy is improved.

Embodiment C

Embodiment C relates to the heating device according to Embodiment B further including a heating target width detector (e.g., width detection sensor 17) to detect a width of the heating target (e.g., recording medium W). The width of the heating target is a length of the heating target in a direction perpendicular to a conveyance direction of the heating target. When the width of the heating target is in excess of a specified length, the temperature detection abnormality detector (e.g., calculator 51) performs the determination on whether each one of the non-contact temperature detectors (e.g., rear non-contact temperature sensor 12*r*, front non-contact temperature sensor 12*f*) has an abnormality or not even when the certain time period has not elapsed.

According to Embodiment C, as described in Modification 1, in a case in which the heating target is wide and the heating member (e.g., upper heat roll 11U) is unlikely to cause a temperature unevenness, the determination on whether each one of the non-contact temperature detectors has an abnormality or not is performed without waiting a lapse of the certain time period. Thus, the throughput is improved.

Embodiment D

Embodiment D relates to the heating device according to Embodiment B in which, when a difference among the first temperatures detected by the non-contact temperature detectors (e.g., rear non-contact temperature sensor 12*r*, front non-contact temperature sensor 12*f*) is within a specified range, the temperature detection abnormality detector (e.g., calculator 51) performs the determination on whether each one of the non-contact temperature detectors (e.g., rear non-contact temperature sensor 12*r*, front non-contact temperature sensor 12*f*) has an abnormality or not even when the certain time period has not elapsed.

According to Embodiment D, as described in Modification 2, in a case in which the heating member (e.g., upper heat roll 11U) has only a small temperature unevenness, the determination on whether each one of the non-contact temperature detectors has an abnormality or not is performed without waiting a lapse of the certain time period. Thus, the throughput is improved.

Embodiment E

Embodiment E relates to the heating device according to Embodiment A in which the temperature detection abnormality detector (e.g., calculator 51) selects one of the non-contact temperature detectors (e.g., rear non-contact temperature sensor 12*r*, front non-contact temperature sensor 12*f*) to be subject to the determination on whether each one of the non-contact temperature detectors (e.g., rear non-contact temperature sensor 12*r*, front non-contact temperature sensor 12*f*) has an abnormality or not, based on a time elapsed after conveyance of the heating target (e.g., recording medium W) is stopped.

According to Embodiment E, as described in Modification 3, before the surface temperature distribution of the heating member (e.g., upper heat roll 11U) has become uniform, any of the non-contact temperature detectors, the detection positions of which have a smaller temperature difference between the detection position of the contact temperature detector, are preferentially subject to the determination. Thus, the throughput is improved.

Embodiment F

Embodiment F relates to the heating device according to Embodiment B in which a target temperature (e.g., target printing temperature T2) of the heating member (e.g., upper heat roll 11U) at the time when conveyance of the heating target (e.g., recording medium W) is started is variable, and the certain time period is variable in accordance with the target temperature.

According to Embodiment F, as described in Embodiment 1, even when the heating target is narrow, the certain time period is shortened in accordance with the target temperature. Thus, the throughput is improved.

Embodiment G

Embodiment G relates to the heating device according to Embodiment B in which the certain time period is variable by an external input.

According to Embodiment G, as described in Embodiment 1, the certain time period elapsed after conveyance of the heating target is stopped before the determination on whether or not each one of the non-contact temperature detectors has an abnormality is performed is variable. Thus, an influence of environmental conditions can be minimized, and the accuracy of abnormality determination is improved.

Embodiment H

Embodiment H relates to the heating device according to Embodiment A in which the temperature detection abnormality detector (e.g., calculator 51) determines that the one of the non-contact temperature detectors (e.g., non-contact temperature sensors 12) has an abnormality when a difference between the first temperature detected by the one of the non-contact temperature detectors (e.g., non-contact temperature sensors 12) and the second temperature detected by the contact temperature detector (e.g., contact temperature sensor 13) is out of a specified range, and the specified range is variable by an external input.

According to Embodiment H, as described in Embodiment 1, an influence of device conditions, such as the types of the temperature sensors 12 and 13 and the upper heat roll 11U, can be minimized. Thus, the accuracy of abnormality determination is improved.

Embodiment I

Embodiment I relates to the heating device according to Embodiment A in which the temperature detection abnormality detector (e.g., calculator 51) performs the determination on whether each one of the non-contact temperature detectors (e.g., rear non-contact temperature sensor 12*r*, front non-contact temperature sensor 12*f*) has an abnormality or not at a time when one of the non-contact temperature detectors (e.g., rear non-contact temperature sensor 12*r*, front non-contact temperature sensor 12*f*) or the contact temperature detector (e.g., contact temperature sensor 13) reaches a specified temperature, and the specified temperature is variable by an external input.

According to Embodiment I, as described in Embodiment 1, the specified temperature at which the determination on whether or not each of the non-contact temperature detectors has an abnormality is variable, and an influence of device conditions, such as the types of the temperature sensors 12 and 13 and the non-contact temperature detector, can be minimized. Thus, the accuracy of abnormality determination is improved.

Embodiment J

Embodiment J relates to the heating device according to Embodiment A further including a contact temperature detector adjuster (e.g., contact/separation motor 60) to bring the contact temperature detector (e.g., contact temperature sensor 13) into contact with the heating member (e.g., upper heat roll 11U) after conveyance of the heating target (e.g., recording medium W) is stopped, and to separate the contact temperature detector from the heating member before conveyance of the heating target is started.

According to Embodiment J, as described in Embodiment 1, the contact temperature detector is prevented from being broken by friction with the heating member, and the surface of the heating member is prevented from being damaged.

Embodiment K

Embodiment K relates to a drying device (e.g., drying device 140) including the heating device (e.g., upper heating mechanism 40) according to Embodiment A to heat a drying target.

According to Embodiment K, as described in Embodiment 1, the plurality of non-contact temperature detectors detect temperature of the heating member and the contact temperature detector determines whether or not the non-contact temperature detectors have an abnormality. The drying device can be composed of a reduced number of assemblies.

Embodiment L

Embodiment L relates to an image forming system (e.g., image forming system 500) including: an image forming device (e.g., printer 120) to apply an ink on a recording medium (e.g., recording medium W) to form an image; and the drying device (e.g., drying device 140) according to Embodiment K disposed downstream from the image forming device relative to a conveyance direction of the recording medium, to heat and dry the recording medium having the image thereon.

According to Embodiment L, as described in Embodiment 1, the image forming system including the drying device that dries an ink on a recording medium can be composed of a reduced number of assemblies.

Embodiment M

Embodiment M relates to an image forming apparatus including: an image forming unit to apply an ink on a recording medium to form an image; and a drying unit including the heating device (e.g., upper heating mechanism 40) according to Embodiment A, to heat and dry the recording medium having the image thereon.

According to Embodiment M, as described in Embodiment 1, the image forming apparatus including the drying unit that dries an ink on a recording medium can be composed of a reduced number of assemblies.

Embodiment N

Embodiment N relates to a fixing device (e.g., fixing device 412) including the heating device (e.g., upper heating mechanism 40) according to Embodiment A to soften or melt a toner on a recording medium (e.g., sheet S) by heat.

According to Embodiment N, as described in Embodiment 2, the plurality of non-contact temperature detectors detect temperature of the heating member and the contact temperature detector determines whether or not the non-contact temperature detectors have an abnormality. The fixing device can be composed of a reduced number of assemblies.

Embodiment O

Embodiment O relates to an image forming apparatus (e.g., image forming apparatus 400) including: a toner image forming device (e.g., image forming unit 450) to form a toner image on a surface of a recording medium (e.g., sheet S) with a toner; and the fixing device according to Embodiment N to heat the surface of the recording medium having the toner image thereon to fix the toner image on the recording medium.

According to Embodiment O, as described in Embodiment 2, the image forming apparatus can be composed of a reduced number of assemblies.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. A heating device comprising:

a heating member configured to contact a heating target being conveyed;

a heat source configured to supply heat to the heating member;

a plurality of non-contact temperature detectors, each of which is configured to detect a respective one of first temperatures of the heating member without contacting the heating member;

a single contact temperature detector configured to detect a second temperature of the heating member by contact with the heating member; and a controller configured to, control drive of the heat source based on the first temperatures detected by the non-contact temperature detectors, and determine whether each one of the non-contact temperature detectors has an abnormality while the heating target is not conveyed, by comparing the first temperatures and the second temperature detected by the single contact temperature detector such that the second temperature detected by the single contact temperature detector is compared against at least two of the first temperatures detected by respective ones of the plurality of non-contact temperature detectors.

2. The heating device of claim 1, wherein the controller is configured to, detect when a certain time period has elapsed after conveyance of the heating target is stopped, and determine whether each one of the non-contact temperature detectors has an abnormality at a time when the certain time period has elapsed after conveyance of the heating target is stopped.

3. The heating device of claim 2, further comprising:

a heating target width detector to detect a width of the heating target, the width being a length of the heating target in a direction perpendicular to a conveyance direction of the heating target, wherein, the controller is configured to determine whether each one of the non-contact temperature detectors has an abnormality prior to the certain time period elapsing, if the width of the heating target is in excess of a specified length.

4. The heating device of claim 2, wherein, when a difference among the first temperatures detected by the non-contact temperature detectors is within a specified range, the controller is configured to determine whether each one of the non-contact temperature detectors has an abnormality prior to the certain time period elapsing.

5. The heating device of claim 2, wherein a target temperature of the heating member at the time when conveyance of the heating target is started is variable, and the certain time period is variable in accordance with the target temperature.

6. The heating device of claim 2, wherein the certain time period is variable by an external input.

7. The heating device of claim 1, wherein the the controller is configured to determine that one of the non-contact temperature detectors has an abnormality when a difference between the respective one of the first temperatures detected by the one of the non-contact temperature detectors and the second temperature detected by the single contact temperature detector is out of a specified range, the specified range is being variable by an external input.

8. The heating device of claim 1, wherein the controller is configured to determine whether each one of the non-contact temperature detectors has an abnormality or not at a time when one of the non-contact temperature detectors or the single contact temperature detector reaches a specified temperature, the specified temperature being variable by an external input.

9. The heating device of claim 1, further comprising:

a contact temperature detector adjuster configured to, bring the single contact temperature detector into contact with the heating member after conveyance of the heating target is stopped, and separate the single contact temperature detector from the heating member before conveyance of the heating target is started.

10. A drying device, comprising:

the heating device of claim 1 configured to heat a drying target.

11. An image forming system, comprising:

an image forming device configured to apply an ink on a recording medium to form an image; and the drying device of claim 10 downstream from the image forming device relative to a conveyance direction of the recording medium, the drying device configured to heat and dry the recording medium having the image thereon.

12. An image forming apparatus, comprising:

an image forming unit configured to apply an ink on a recording medium to form an image; and a drying unit including the heating device of claim 1, the drying unit configured to heat and dry the recording medium having the image thereon.

13. A fixing device, comprising:

the heating device of claim 1 to soften or melt a toner on a recording medium by heat.

14. An image forming apparatus, comprising:

a toner image forming device to form a toner image on a surface of a recording medium with a toner; and the fixing device of claim 13 to heat the surface of the recording medium having the toner image thereon to fix the toner image on the recording medium.

15. The heating device of claim 1, wherein the controller is configured to, determine whether each one of the non-contact temperature detectors has an abnormality by bringing the single contact temperature detector into contact with the heating member after an elapsed time, the elapsed time occurring prior to conveying the heating target, and vary the elapsed time based on a width of the heating target in a direction perpendicular to a conveyance direction of the heating target.

16. The heating device of claim 15, wherein, the controller is configured to, set the elapsed time to zero, if the width of the heating target is greater than or equal to a width of the heating member, and set the elapsed time to a value greater than zero, if the width of the heating target is less than the width of the heating member.

17. The heating device of claim 1, wherein the controller is configured to perform a verify check on multiple ones of the plurality of non-contact temperature detectors using the single contact temperature detector.

18. The heating device of claim 17, wherein the heating member includes an upper heat roll and a lower heat roll, the plurality of non-contact temperature detectors includes a front non-contact temperature detector and a rear non-contact temperature detector at a front end side and a rear end side of the upper heat roll, respectively, and the single contact temperature detector is at the rear end side of the upper heat roll.

* * * * *